US012478106B2

(12) United States Patent
Lei

(10) Patent No.: US 12,478,106 B2
(45) Date of Patent: Nov. 25, 2025

(54) ATOMIZER AND ELECTRONIC ATOMIZING DEVICE

(71) Applicant: Shenzhen Smoore Technology Limited, Shenzhen (CN)

(72) Inventor: Guilin Lei, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 449 days.

(21) Appl. No.: 17/706,626

(22) Filed: Mar. 29, 2022

(65) Prior Publication Data

US 2022/0218037 A1 Jul. 14, 2022

Related U.S. Application Data

(63) Continuation of application No. PCT/CN2019/110657, filed on Oct. 11, 2019.

(30) Foreign Application Priority Data

Sep. 30, 2019 (CN) ..... 201910944487.1

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/44* (2020.01)

(58) Field of Classification Search
CPC ..... A24F 40/10; A24F 40/485; A24F 40/40; A24F 40/42; A24F 40/44
See application file for complete search history.

(56) References Cited

U.S. PATENT DOCUMENTS

2013/0306064 A1 11/2013 Thorens et al.
2015/0230522 A1 8/2015 Horn et al.
(Continued)

FOREIGN PATENT DOCUMENTS

CN 101325118 A 12/2008
CN 101349447 A 1/2009
(Continued)

OTHER PUBLICATIONS

CN206119188U, Nebulizer and electronic cigarette with same, (Year: 2017).*
(Continued)

*Primary Examiner* — Michael H. Wilson
*Assistant Examiner* — Stephanie Lynn Moore

(57) ABSTRACT

An atomizer and an electronic atomizing device, includes an atomizing member and an airflow channel including an air outlet channel A first liquid suction structure and a second liquid suction structure having a fluid connection with the first liquid suction structure are defined on the air outlet channel to absorb a condensate formed on the air outlet channel by capillary forces. The second liquid suction structure is located between the atomizing member and the first liquid suction structure, and has a capillary force greater than that of the first liquid suction structure. A liquid storage groove that absorbs and stores the condensate by the capillary force is defined on the second liquid suction structure. The condensate in the first liquid suction structure reaches the second liquid suction structure by the capillary force of the liquid storage groove and is then absorbed and stored.

16 Claims, 7 Drawing Sheets

(51) Int. Cl.
*A24F 40/42* (2020.01)
*A24F 40/44* (2020.01)

(56) References Cited

U.S. PATENT DOCUMENTS

| | | | | |
|---|---|---|---|---|
| 2016/0145677 | A1 | 5/2016 | Chee et al. | |
| 2016/0366944 | A1 | 12/2016 | Larson | |
| 2017/0119055 | A1 | 5/2017 | Liu | |
| 2017/0143038 | A1* | 5/2017 | Dickens | A24F 40/485 |
| 2017/0273360 | A1 | 9/2017 | Brinkley et al. | |
| 2017/0367402 | A1 | 12/2017 | Lau et al. | |
| 2018/0116289 | A1 | 5/2018 | Qiu | |
| 2019/0014826 | A1* | 1/2019 | Thorens | A24D 3/17 |
| 2019/0124990 | A1 | 5/2019 | Qiu | |
| 2019/0364967 | A1* | 12/2019 | Wu | A24F 40/485 |
| 2021/0274846 | A1 | 9/2021 | Potter | |

FOREIGN PATENT DOCUMENTS

| | | | | |
|---|---|---|---|---|
| CN | 102264249 | A | | 11/2011 |
| CN | 102264420 | A | | 11/2011 |
| CN | 202265459 | U | | 6/2012 |
| CN | 102788780 | A | | 11/2012 |
| CN | 103237469 | A | | 8/2013 |
| CN | 103653260 | A | | 3/2014 |
| CN | 103781375 | A | | 5/2014 |
| CN | 203913387 | U | | 11/2014 |
| CN | 105012987 | A | | 11/2015 |
| CN | 105192895 | A | | 12/2015 |
| CN | 105212277 | A | | 1/2016 |
| CN | 105433443 | A | | 3/2016 |
| CN | 105841535 | A | * | 8/2016 |
| CN | 205456063 | U | | 8/2016 |
| CN | 105934171 | A | | 9/2016 |
| CN | 105962419 | A | | 9/2016 |
| CN | 106072767 | A | | 11/2016 |
| CN | 106455725 | A | | 2/2017 |
| CN | 206119188 | U | * | 4/2017 |
| CN | 106820272 | A | | 6/2017 |
| CN | 206390306 | U | | 8/2017 |
| CN | 206576295 | U | | 10/2017 |
| CN | 107613797 | A | | 1/2018 |
| CN | 207100509 | U | | 3/2018 |
| CN | 208175992 | U | | 12/2018 |
| CN | 208286373 | U | | 12/2018 |
| CN | 208425527 | U | | 1/2019 |
| CN | 109757779 | A | | 5/2019 |
| CN | 109805456 | A | | 5/2019 |
| CN | 208837093 | U | | 5/2019 |
| CN | 109864347 | A | | 6/2019 |
| CN | 110051045 | A | | 7/2019 |
| CN | 209093053 | U | | 7/2019 |
| CN | 110074464 | A | | 8/2019 |
| CN | 209234987 | U | | 8/2019 |
| CN | 209284324 | U | | 8/2019 |
| CN | 110236233 | A | | 9/2019 |
| CN | 110250576 | A | | 9/2019 |
| CN | 110250582 | A | | 9/2019 |
| CN | 209346086 | U | | 9/2019 |
| CN | 209346109 | U | | 9/2019 |
| CN | 209359557 | U | | 9/2019 |
| CN | 209376684 | U | | 9/2019 |
| CN | 110638101 | A | | 1/2020 |
| CN | 211091889 | U | | 7/2020 |
| IN | 206119187 | U | | 4/2017 |
| JP | 2004147634 | A | | 5/2004 |
| JP | 2019512220 | A | | 5/2019 |
| JP | 2019515692 | A | | 6/2019 |
| JP | 2019526243 | A | | 9/2019 |
| KR | 20090130658 | A | | 12/2009 |
| KR | 20110005963 | A | | 1/2011 |
| WO | 2018161254 | A1 | | 9/2018 |
| WO | 2018211390 | A1 | | 11/2018 |
| WO | 2020176901 | A2 | | 9/2020 |

OTHER PUBLICATIONS

CN105841535A, Sectional composite-structure panel heat transfer tube and manufacture method thereof, (Year: 2016).*
Heat pipe technology and its engineering application,Published by Chemical Industry Press,Published on Jun. 1, 2000,,Zhuang et al p. 236.
Engineering Convective Heat Transfer, Machinery Industry Press, Dec. 1982, first edition,Zhuo Ning et al.,p. 200.
International Search Report with written opinion, International application No. PCT/CN2019/109705, mailed Jun. 24, 2020(11 pages).
International Search Report with written opinion, International application No. PCT/CN2019/109703, mailed Jun. 29, 2020(11 pages).
International Search Report with written opinion, International application No. PCT/CN2019/110657, mailed Jun. 23, 2020(10 pages).
Chinese first office action, Chinese application No. 201910944487.1, mailed Jun. 17, 2020(23 pages).
Chinese second office action, Chinese application No. 201910944487.1,mailed Apr. 13, 2021(20 pages).
Chinese rejection decision, Chinese application No. 201910944487.1, mailed Oct. 11, 2021(19 pages).
Chinese first office action, Chinese application No. 201910944489.0,mailed Sep. 1, 2021(24 pages).
Chinese first office action, Chinese application No. 201910944516.4, mailed Sep. 3, 2021(25 pages).
Chinese first office action, Chinese application No. 201990001344.0,mailed Dec. 31, 2021(5 pages).
European Search Report, European Application No. 19947639.1, mailed May 24, 2023 (8 pages).
European Search Report, Application No. 19948182.1, mailed Sep. 29, 2022(8 pages).
Energy saving principle and technology,Zhuo Ning, et al., China Machine Press, published on Dec. 31, 1982, p. 200.
Thermal control technology of spacecraft,Miao Jianyin et al., published on Mar. 31, 2018, pp. 14-15.
Principle and technology of solar thermal utilization, Dai Yanjun et al., published on Dec. 31, 2018, p. 339.
Chinese third office action,Application No. 201910944516.4,mailed Nov. 2, 2022(29 pages).
Chinese Rejection decision,Application No. 201910944489.0,mailed Sep. 27, 2022(26 pages).
Examination Report,European Application No. 19947757.1, mailed Sep. 26, 2023 (4 pages).
Korean Request for the Submission of an Opinion,Patent Application No. 10-2021-7041530 , mailed Nov. 29, 2023 (45 pages).
Japanese Notice of Reasons for Refusal,Japanese Patent Application No. 2022-500642 ,mailed Sep. 19, 2023(8 pages).
Japanese Decision to Grant a Patent,Japanese Application No. 2022-500642, mailed Nov. 21, 2023(5 pages).
Chinese Review Decision Letter, Chinese Application No. 201910944487.1, mailed Nov. 22, 2023 (7 pages).
Chinese second office action,Application No. 201910944516.4,mailed May 10, 2022(23 pages).
Chinese second office action,Application No. 201910944489.0,mailed Apr. 24, 2022(29 pages).
Japanese Notice of Reasons for Refusal,Japanese Patent Application No. 2022-500642 ,mailed Mar. 14, 2023(8 pages).
European office action,European Application No. 19947757.1, mailed Feb. 20, 2023(5 pages).
Chinese First Office Action,Chinese Application No. 201910945738.8, mailed Nov. 14, 2024 (16 pages).
US Non Final OA, U.S. Appl. No. 17/705,616, US mailed Aug. 19, 2024(18 pages).
US Non Final OA, U.S. Appl. No. 17/706,635, US mailed Aug. 23, 2024(23 pages).

* cited by examiner

ATOMIZER AND ELECTRONIC ATOMIZING DEVICE

CROSS-REFERENCE TO RELATED APPLICATIONS

The present application is a continuation-application of International (PCT) Patent Application No. PCT/CN2019/110657 filed Oct. 11, 2019, which claims priority and rights of Chinese Patent Application No. 201910944487.1, filed on Sep. 30, 2019, in the National Intellectual Property Administration of China, the entire contents of which are hereby incorporated by reference in its entirety.

TECHNICAL FIELD

The disclosure relates to an atomizing device, in particular to an atomizer and an electronic atomizing device.

BACKGROUND

Electronic cigarettes are also known as virtual cigarettes and electronic atomizing devices. As an alternative to cigarettes, the electronic cigarettes are mostly used to quit smoking. The electronic cigarettes have a similar appearance and taste to cigarettes, but generally do not contain harmful components such as tar and suspended particles, and so on, in cigarettes.

In the related art, for an electronic atomizing device, a suction liquid leakage is easily to occur as a result of incompletely atomized e-liquid during being heated and a condensate appearing due to a condensation during use, which may greatly affect safety of the electronic cigarettes and user experience.

SUMMARY OF THE DISCLOSURE

The technical problem to be solved by the present disclosure is: in the related art, during a suction process, some condensed liquid drops or liquid surface may be generated on a side wall of an airflow channel as a suction time increases, and the generated liquid drops are easily to be brought out in response to a subsequent suction, thereby user experience may be affected. Therefore, an atomizer and an electronic atomizing device are provided.

The technical solutions adopted by the present disclosure to solve its technical problems are to provide an atomizer, and the atomizer includes an atomizing member; and an airflow channel, including an air outlet channel A first liquid suction structure and a second liquid suction structure having a fluid connection with the first liquid suction structure are defined on the air outlet channel The first liquid suction structure and the second liquid suction structure are configured to absorb a condensate formed on the air outlet channel by capillary forces. The second liquid suction structure is located between the atomizing member and the first liquid suction structure, and the capillary force of the second liquid suction structure is greater than that of the first liquid suction structure. A liquid storage groove that absorbs and stores the condensate by the capillary force is defined on the second liquid suction structure. The condensate in the first liquid suction structure reaches the second liquid suction structure by the capillary force of the liquid storage groove and is then absorbed and stored.

In some embodiments, the second liquid suction structure has an inner wall, the inner wall is concaves to form the liquid storage groove, and the inner wall of the second liquid suction structure encloses a part of the air outlet channel In some embodiments, the first liquid suction structure is a liquid suction groove extending along a longitudinal direction of an inner wall of the air outlet channel, and one end of the liquid suction groove is butted with the liquid storage groove.

In some embodiments, the number of the liquid suction groove is several, and the liquid suction grooves are evenly distributed along a peripheral wall of the air outlet channel.

In some embodiments, the air outlet channel includes a first airway wall and a second airway wall detachable with the first airway wall, the first liquid suction structure is defined on the first airway wall, and the second airway wall is an inner wall of the first liquid suction structure.

In some embodiments, the second liquid suction structure is defined on an integrally formed single element.

In some embodiments, the atomizing member includes a cylindrical atomizing core and a liquid guiding cotton surrounding the atomizing core. The liquid guiding cotton is in the fluid connection to the liquid storage groove of the second liquid guiding structure for guiding liquid.

In some embodiments, a bottom of the second liquid suction structure abuts the liquid guiding cotton, and a liquid returning structure is arranged on the bottom of the second liquid suction structure to make the liquid storage groove be in the fluid connection to the liquid guiding cotton for guiding liquid.

In some embodiments, the liquid returning structure is a liquid returning groove or a liquid outlet or a stepped structure.

In some embodiments, the liquid storage groove is a horizontal liquid storage groove or a longitudinal liquid storage groove or a threaded liquid storage groove.

In some embodiments, the second liquid suction structure includes at least one liquid guiding groove fluidly coupled to a part of the liquid storage groove and used to dispense a condensate.

In some embodiments, a groove depth of the liquid suction groove is configured to be gradually increased toward the liquid storage groove; and/or a groove width of the liquid suction groove is configured to be gradually increased toward the liquid storage groove; and/or the groove width of the liquid suction groove is configured to be gradually increased from a bottom of the liquid suction groove to an opening of the liquid suction groove.

According a second aspect, an electronic atomizing device is provided and includes an atomizing member; and an airflow channel including an air outlet channel A first liquid suction structure and a second liquid suction structure having a fluid connection with the first liquid suction structure are defined on the air outlet channel The first liquid suction structure and the second liquid suction structure are configured to absorb a condensate formed on the air outlet channel by capillary forces. The second liquid suction structure is located between the atomizing member and the first liquid suction structure, and the capillary force of the second liquid suction structure being greater than that of the first liquid suction structure. A liquid storage groove that absorbs and stores the condensate by the capillary force is defined on the second liquid suction structure. The condensate in the first liquid suction structure reaches the second liquid suction structure by the capillary force of the liquid storage groove and is then absorbed and stored.

In some embodiments, the first liquid suction structure is a liquid suction groove extending along a longitudinal direction of an inner wall of the air outlet channel, and one end of the liquid suction groove is butted with the liquid storage groove.

In some embodiments, the air outlet channel includes a first airway wall and a second airway wall detachable with the first airway wall, the first liquid suction structure is defined on the first airway wall, and the second airway wall is an inner wall of the first liquid suction structure.

In some embodiments, the atomizing member includes a cylindrical atomizing core; and a liquid guiding cotton surrounding the atomizing core; and the liquid guiding cotton is in the fluid connection to the liquid storage groove of the second liquid guiding structure for guiding liquid.

In some embodiments, a bottom of the second liquid suction structure abuts the liquid guiding cotton, and a liquid returning structure is arranged on the bottom of the second liquid suction structure to make the liquid storage groove be in the fluid connection to the liquid guiding cotton for guiding liquid.

In some embodiments, the liquid returning structure is a liquid returning groove or a liquid outlet or a stepped structure.

In some embodiments, the second liquid suction structure includes at least one liquid guiding groove fluidly coupled to a part of the liquid storage groove and used to dispense a condensate.

BRIEF DESCRIPTION OF THE DRAWINGS

The present disclosure will be further described in the following in conjunction with the accompanying drawings and embodiments.

DETAILED DESCRIPTION

Figure 1:
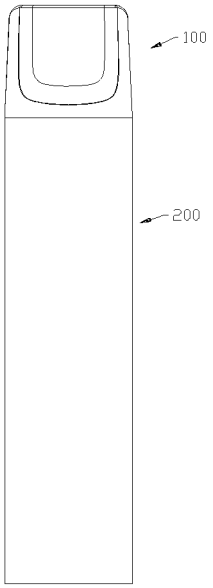
FIG. 1 is a perspective structural schematic view of an electronic atomizing device according to some embodiments of the present disclosure.
Figure 2:
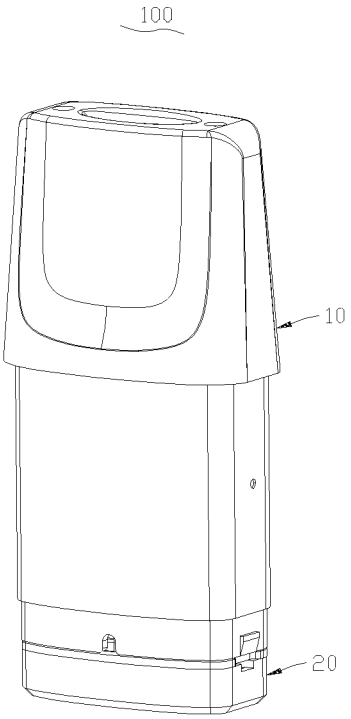
FIG. 2 is a perspective structural schematic view of an atomizer of the electronic atomizing device shown in FIG. 1.
Figure 3:
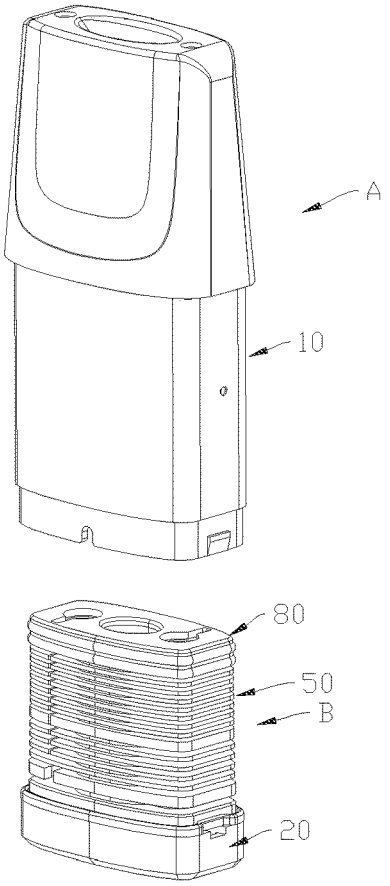
FIG. 3 is a partial exploded schematic view of the atomizer shown in FIG. 2.
Figure 4:
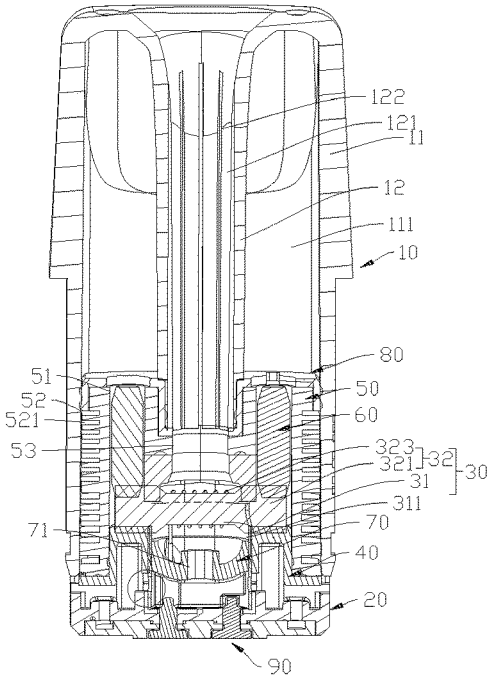
FIG. 4 is a cross-sectional view of the atomizer shown in FIG. 2.
Figure 5:
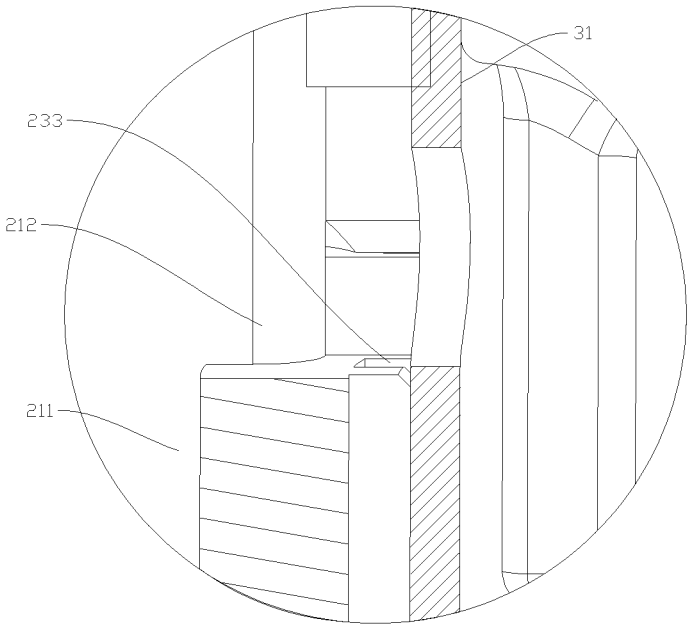
FIG. 5 is a partial enlarged schematic diagram of the atomizer shown in FIG. 4.
Figure 6:
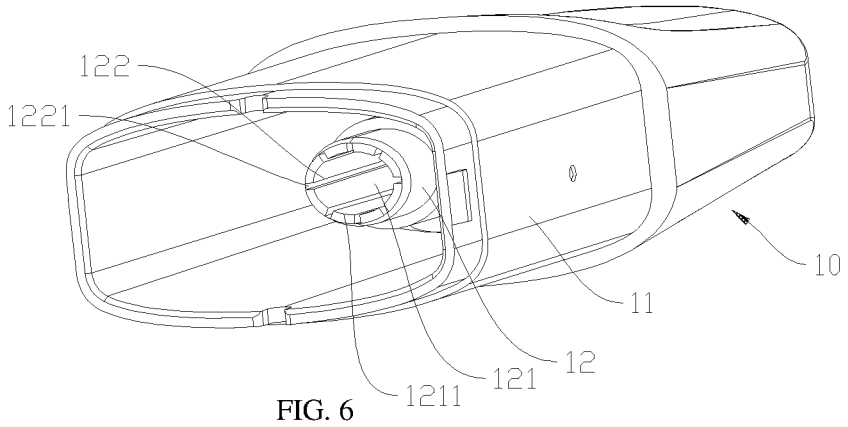
FIG. 6 is a perspective structural schematic view of a housing of the atomizer shown in FIG. 4.
Figure 7:
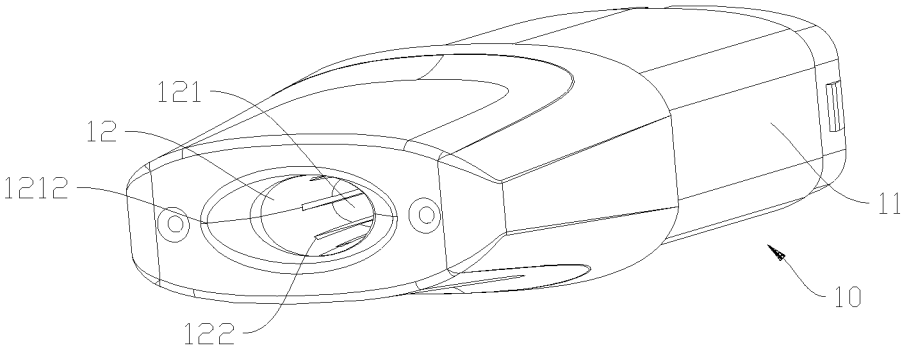
FIG. 7 is a perspective structural schematic view of the housing of the atomizer shown in FIG. 4 from another viewpoint.
Figure 8:
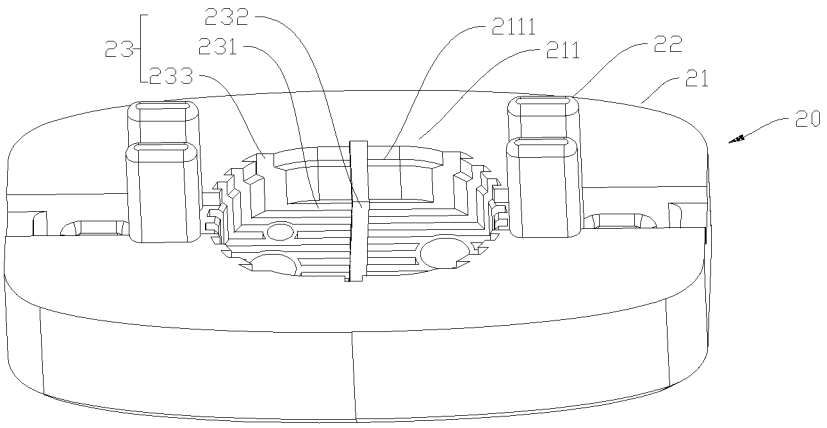
FIG. 8 is a perspective structural schematic view of a base of the atomizer shown in FIG. 4.

In order to make the technical features, objectives and effects of the present disclosure be understood more clearly, the specific embodiments of the present disclosure will be described in detail with reference to the accompanying drawings in the following.

Limitation of orientation: an upper, a lower, a top, a bottom of the present disclosure are an upper, a lower, a top, a bottom shown in the accompanying drawings. It should be understood that an orientation or positional relationship indicated by "upper", "lower", etc. is based on the orientation or positional relationship shown in the drawings. Constructing and operating in a specific orientation is only for a convenience of describing the technical solution, not indicating that the related device or elements must have a specific orientation, and should not be understood as a limitation of the present disclosure.

A first embodiment of an electronic atomizing device of the present disclosure is shown in FIG. 1 to FIG. 4. The electronic atomizing device is applied to atomize a liquid medium such as an e-liquid, a medicine, and so on. The electronic atomizing device includes an atomizer and a power supply device mechanically and electrically connected to the atomizer. The atomizer is used to heat and atomize the liquid medium, and the power supply device is used to power the atomizer. In some embodiments, the atomizer and the power supply device are detachably connected. The power supply device includes a power supply housing, a battery disposed in the power supply housing, conductive contacts disposed in the power supply housing and connected to the battery and the atomizer, and a control circuit disposed in the power supply housing and electrically connected to the battery and the atomizer.

As shown in FIG. 3 to FIG. 7, in the present embodiment, the atomizer includes a housing 10, a base 20, an atomizing member 30, a first seal element 40, a gas-liquid balance element 50, and liquid guiding elements 60. The housing 10 is sleeved on a periphery of the atomizing member 30, and a liquid storage cavity 111 is defined in an inner side of the housing 10 used for accommodating the liquid medium. In the present embodiment, the liquid medium is e-liquid. The base 20 is used to be arranged with the atomizing member 30, and the housing 10 is sleeved on the base 20. The atomizing member 30 is arranged in the housing 10 and located on the base 20. The first seal element 40 is arranged on the base 20 configured for sealing a connection between the atomizing member 30 and the base 20. The gas-liquid balance element 50 is arranged in the housing 10 and located on a lower part of the liquid storage cavity 111, being sleeved on the periphery of the atomizing member 30 and located on the base 20. The liquid storage cavity 111 is in a fluid connection to an outside by the gas-liquid balance element 50, such that an air pressure in the liquid storage cavity 111 may be balanced. The liquid guiding elements 60 may be two. It can be understood that, in other embodiments, the liquid guiding element 60 may be one, or the liquid guiding elements 60 may be more. The liquid guiding elements 60 are penetrated through the gas-liquid balance 50, and configured to fluidly connect the liquid storage cavity 111 with the atomizing member 30, so as to provide the liquid medium to the atomizing member 30. It is understandable that, in other embodiments, both the gas-liquid balance element 50 and the liquid guiding elements 60 may be omitted.

Furthermore, in the present embodiment, the housing 10 includes a housing body 11 and an air outlet tube 12, and the housing body 11 and the air outlet tube 12 are integrally formed by an injection molding process. Understandably, in other embodiments, the air outlet tube 12 and the housing body 11 are two separate structures. The housing body 11 is sleeved on the base 20 and the atomizing member 30, a space is defined in the housing body 11 and above the atomizing member 30, and the liquid storage cavity 111 is defined in the space. The housing body 11 has a central axis, the air outlet tube 12 is arranged in the housing body 11 substantially along the central axis, and be in the fluid connection to the atomizing member 30, and located at the central axis of the housing body 11. It can be understood that, in other embodiments, the air outlet tube 12 may be arranged in a side of the housing body 11 and is not limited to be at the central axis of the housing body 11. The air outlet tube 12 may also be arranged obliquely. An air outlet channel 121 is defined in the air outlet tube 12, arranged along a direction of an axis of the air outlet tube 12, and a side wall of the air outlet channel 121 is integrally formed with the housing 10. An atomized gas generated in response to a user inhaling may enter a mouth of the user passing through the air outlet channel 121. The air outlet channel 121 has a first end 1211 and a second end 1212, the second end 1212 is inserted into the atomizing member 30, and the first end 1211 is defined with a cigarette holder for the user to inhale the atomized gas. At least one first liquid suction groove 122 is defined on an inner side wall of the air outlet tube 12. In the present embodiment, the at least one first liquid suction groove 122 may be multiple. It can be understood that in other embodiments, the at least one first liquid suction groove 122 may be one. The first liquid suction groove 122 has a capillary function of absorbing a condensate formed on the side wall of the air outlet channel 121. The condensate will flow to the atomizing member 30 from the first liquid suction groove 122 under a gravity action of the condensate, and is atomized again by the atomizing member 30. In this way, a utilization rate of the liquid medium may be improved.

Further, in the present embodiment, the multiple first liquid suction grooves 122 are defined on the inner side of the air outlet tube 12, and arranged along a circumferential direction of the air outlet channel 121 at intervals. In response to the atomized gas reaching an air outlet through the air outlet channel 121, a gas flow around the air outlet channel 121 will be condensed to the condensate as a result of being contacted with the inner side of the air outlet tube 12, in which case, the condensate will be sucked into the first liquid suction grooves 122 by a capillary action. In the present embodiment, the first liquid suction grooves 122 are arranged along a longitudinal direction of the air outlet channel 121 extending from the second end 1212 of the air outlet channel 121 toward the first end 1211 of the air outlet channel 121, are substantially parallel to a central axis of the air outlet channel 121. Besides, the first liquid suction grooves 122 have a fluid connection with the atomizing member 30, such that the condensate may flow to a top of the atomizing member 30 along an extending direction of the first liquid suction groove 122 under the gravity action of the condensate, and be dropped on the atomizing member 30 to be atomized again. In this way, a utilization rate of the liquid medium may be improved, and a possibility of the liquid medium being sucked into the user's mouth may be reduced, and thus user experience may be improved. In the present embodiment, the first liquid suction grooves 122 are not limited to be arranged longitudinally, and may be arranged spirally or obliquely.

In the present embodiment, an outlet 1221 is defined on a surface of the first end 1211 of the air outlet channel 121. The outlet 1221 is in the fluid connection with the first liquid suction grooves 122, and in the fluid connection to the atomizing member 30. It may be convenient for a liquid in the first liquid suction grooves 122 to be dropped on the atomizing member 30 through the outlet 1221.

In the present embodiment, groove depths of the first liquid suction grooves 122 are set to be gradually reduced in a direction away from the outlet 1221. Bottom surfaces of the first liquid suction grooves 122 are slopes inclined toward a direction of the outlet 1221, such that less liquid is stored in an upper part of the first liquid suction grooves 122, while more liquid is stored in a lower part of the first liquid suction grooves 122. In this way, a possibility that the liquid in the upper part of the first liquid suction grooves 122 is sucked into the use's mouth may be further reduced. Through the bottom surfaces of the first liquid suction grooves 122 being arranged to be the slopes inclined toward the direction of the outlet 1221, a resistance that the liquid in the lower part of the first liquid suction grooves 122 are sucked out may be increased which may further reduce an occurrence of the liquid being sucked into the user's mouth. Specifically, in the present embodiment, each of the groove depths of the first liquid suction grooves 122 may be greater than or equal to 0.1 mm. In the present embodiment, groove widths of the first liquid suction grooves 122 are set to be gradually increased along an opening direction of the first liquid suction grooves 122. The opening direction of the first liquid suction grooves 122 is substantially perpendicular to and directed to the central axis of the air outlet channel 121. In this way, the first liquid suction grooves 122 may have characteristics of narrow inside and wide opening. In this way, it may facilitate the liquid to flow to the atomizing member 30 along the first liquid suction grooves 122. In the present embodiment, the width of each of the first liquid suction grooves 122 may be 0.05-1 mm.

In FIG. 4 to FIG. 8, in the present embodiment, the housing 10 further includes a housing opening. The base 20 further includes a seat body 21, a support member 22 arranged on the seat body 21, and a liquid storage structure 23. A shape and size of a cross-section of the seat body 21 are adapted to a shape and size of the housing opening of the housing 10, such that the housing opening of the housing 10 may be blocked by the seat body 21. A groove 211 is defined on the base 20. Specifically, the groove 211 is defined on an end of the seat body 21 facing towards an atomizing cavity 311 of the atomizing member 30, such that the liquid storage structure 23 may be defined at a bottom of the atomizing cavity 311. The support member 22 includes two groups of support columns arranged at intervals, and one group support columns are arranged on a side of the groove 211, while the other group support columns are arranged on an opposite side of the groove 211. The support columns are used to support an atomizing member 32 in the atomizing member 30. The liquid storage structure 23 is defined in the groove 211, and in the fluid connection to the atomizing cavity 311 of the atomizing member 30. The liquid storage structure 23 is used to store the liquid medium to reduce a possibility of the liquid medium leaking out.

Further, in the present embodiment, the liquid storage structure 23 includes a plurality of second liquid suction grooves 231, a liquid dispensing groove 232, and a plurality of flow guiding grooves 233. The plurality of second liquid suction grooves 231 are defined side by side on the bottom of the groove 211 at intervals, facing towards the atomizing cavity 311, and having a capillary function to absorb the liquid medium dropped from the atomizing cavity 311 or the air outlet channel 121. The number of the second liquid suction grooves 231 is not limited to be multiple, and may be one. The liquid dispensing groove 232 is defined on a bottom surface of the groove 211, intersected with the plurality of second liquid suction grooves 231. The liquid dispensing groove 232 further crosscuts the second liquid suction grooves 231, and is in the fluid connection to the second liquid suction grooves 231. The liquid dispensing groove 232 is used for shunting, so as to absorb the liquid medium faster. The plurality of flow guiding grooves 233 are defined on a side wall of the groove 211 at intervals, arranged correspondingly to the second liquid suction grooves 231 and the liquid dispensing groove 232, and in the fluid connection to the second liquid suction groove 231 and the liquid dispensing groove 232. The flow guiding grooves 233 have a capillary function used for guiding liquid into the second liquid suction grooves 231.

Further, in the present embodiment, each of the second liquid suction grooves 231 extends along a transverse direction of the bottom surface of the groove 211. That is, each of the second liquid suction grooves 231 extends along a transverse direction of the atomizing cavity 311, and a flowing direction of the liquid medium is controlled by the second liquid suction grooves 231, such that a possibility of leaking liquid may be effectively reduced. In the present embodiment, the groove width of each of the second liquid suction grooves 231 is 0.05-1 mm, and the groove depth of each of the second liquid suction grooves 231 is greater than 0.1 mm. Understandably, in some other embodiments, the groove depth of each of the second liquid suction grooves 231 may be also equal to 0.1 mm.

Furthermore, in the present embodiment, the liquid dispensing groove 232 is substantially perpendicular to each of the second liquid suction grooves 231, and divides each of the second liquid suction grooves 231 into two sections. A groove width of the liquid dispensing groove 232 is greater than the groove width of each of the second liquid suction grooves 231. In this way, a liquid absorbing rate may be improved, and a possibility that the liquid medium penetrates to an outside from electrode pores may be reduced.

Further, in the present embodiment, the flow guiding grooves 233 are defined on the side wall of the groove 211 and extends along a longitudinal direction of the base 20. Each of the flow guiding grooves 233 is correspondingly in the fluid connection to one second liquid suction groove 231 and the liquid dispensing groove 232. The flow guiding grooves 233 are used to guide the liquid medium to the second liquid suction grooves 231 and the liquid dispensing groove 232. In the present embodiment, groove openings of ends of the flow guiding grooves 233 away from the second liquid suction grooves 231 and the liquid dispensing groove 232 are defined on an outside of the atomizing cavity 311 to absorb a liquid leakage from the outside of the atomizing cavity 311. In the present embodiment, the atomizing member 30 includes an atomizing housing 31. A step 2111 is arranged on an inner side wall of the groove 211, and used to be assembled with the atomizing housing 31 of the atomizing member 30 to improve a member compactness. In the present embodiment, the flow guiding grooves 233 have a capillary force used to absorb the liquid leakage and guide the liquid leakage to the second liquid suction grooves 231. In the present embodiment, the groove width of each of the flow guiding grooves 233 may be 0.05-1 mm. It is understandable that in some other embodiments, the groove width of each of the flow guiding grooves 233 may be not limited to be 0.05-1 mm.

Further, in the present embodiment, the atomizing member 30 further includes an atomizing element 32. The atomizing housing 31 is sleeved on the base 20 and inserted into the groove 211. The atomizing housing 31 is connected with the first seal element 40. The atomizing housing 31 is used for the atomizing element 32 to be assembled with, such that the atomizing element 32 may be fixed. The atomizing gravity 311 is defined in an inner side of the atomizing housing 31, located on an upper part of the base 20, and in the fluid connection to the first liquid suction grooves 122 directly. A liquid leakage tends to occur at which place the atomizing housing 31 contacts the atomizing element 32. The liquid medium is easy to leak out from where the first seal element 40 is connected with the atomizing housing 31. The groove openings of the ends of the flow guiding grooves 233 away from the second liquid suction grooves 231 and the liquid dispensing groove 232 face towards a connection between the first seal element 40 and the atomizing housing 31. In some embodiments, the groove openings substantially right face towards the connection between the first seal element 40 and the atomizing housing 31, and absorb the liquid leakage where the connection is through the capillary force. The atomizing element 32 penetrates through the atomizing housing 31 along a transverse direction. The atomizing element 32 includes an atomizing core 321 penetrating through the atomizing housing 31 and a heating body 322 entangled on the atomizing core 321. The atomizing core 321 may be a cotton core. Both ends of the atomizing core 321 are located on the two groups of the support columns disposed on the seat body 21. The atomizing core 321 has a fluid connection with the liquid guiding elements 60. The atomizer further includes an electrode 90. A conductive connection element of the heating body 322 penetrates into the base 20 and is connected to an electrode 90. In the present embodiment, the heating body 322 may be a heating wire.

Further, in the present embodiment, the first seal member 40 is sleeved on the base 20, and sleeved on a periphery of the atomizing housing 31. Specifically, the first seal member 40 may be a sealing sleeve. The sealing sleeve may be a silicone sleeve or a rubber sleeve. Understandably, in some other embodiments, the first seal member 40 is not limited to be a silicone sleeve or a rubber sleeve.

Further, in the present embodiment, the gas-liquid balance element 50 is in a cylindrical shape. Specifically, a cross-section of the gas-liquid balance element 50 is elliptical or rectangular shape. An outer circumference of the gas-liquid balance element 50 is connected with an inner wall surface of the housing 10 in a manner of interference fit to block the liquid storage cavity 111. In the present embodiment, the gas-liquid balance element 50 includes two vias 51, a liquid-storing gas-exchanging structure 52 located on a periphery of the vias 51, and an airflow passageway 53 located between the two vias 51. The liquid guiding elements 60 may insert into the vias 51. The liquid-storing gas-exchanging structure 52 is used to fluidly connect the liquid storage cavity 111 to the outside, to balance atmospheres in the liquid storage cavity 111. The liquid-storing gas-exchanging structure 52 includes a plurality of liquid storage grooves 521 disposed side by side and two gas returning grooves. The liquid storage grooves 521 may generate a capillary force for the liquid medium, and used to store the liquid medium, such that the possibility of the liquid leakage may be reduced. The gas returning grooves are defined along a longitudinal direction, crosscut the liquid storage grooves 521, and in the fluid connection to the liquid storage grooves 521 and the liquid storage cavity 111. Gas may enter the liquid storage cavity 111 through the gas returning grooves. The airflow passageway 53 is in the fluid connection to the air outlet channel 121 to further facilitate the air outlet channel 121 being in the fluid connection to the atomizing cavity 311. A temperature gas exchanging process may be performed through setting the gas-liquid balance element 50, such that an occurrence of a frying oil and a burnt smell caused by a long-term absence of gas exchanging process (insufficient liquid supply) may be reduced, and an occurrence of large-particle droplets and the liquid leakage caused by a sudden large-scale gas exchanging process (too much liquid supply) may be also reduced. Besides, structural gaps may be sealed by forming an independent gas exchanging channel. In this way, the occurrence of the liquid leakage caused by capillary forces of the gaps and environmental changes may be reduced, and an occurrence of suction liquid leakage and the condensate being sucked out may be also reduced, such that a product yield may be improved.

Further, in the present embodiment, the liquid guiding elements 60 are arranged corresponding to the vias 51 of the gas-liquid balance element 50, penetrating the vias 51, and located at the both ends of the atomizing core 321. The liquid guiding element 60 has a fluid connection with the atomizing core 321. The liquid guiding element 60 may be a cotton core, and it is understood that in some other embodiments, the liquid guiding element 60 is not limited to be the cotton core.

Further, in the present embodiment, the atomizer further includes a fixing sleeve 70. The fixing sleeve 70 is used to fix the conductive connection element of the heating body 322, facilitating to position the conductive connection element of the heating body 322. The conductive connecting element of the heating body 322 is configured to penetrate the fixing sleeve 70. A through hole 71 that is in the fluid connection to the atomizing cavity 311, is defined on the fixing sleeve 70, disposed substantially along the longitudinal direction, and in the fluid connection to the air outlet channel 121 to facilitate a gas circulation. In the present embodiment, the fixing sleeve 70 may be a silicone sleeve. Understandably, in some other embodiments, the fixing sleeve 70 may be omitted.

Further, in the present embodiment, the atomizer further includes a second seal element 80. The second seal element 80 may be a sealing sleeve, sleeved on the gas-liquid balance element 50. There are yielding holes defined on the second seal element 80, disposed corresponding to the liquid guiding element 60 and the air outlet channel 121. The second seal element 80 may be a silicone sleeve or a rubber sleeve.

Further, in the present embodiment, the electrode 90 includes two electrode columns, one electrode column is a positive pole column, and the other electrode column is a negative pole. The two electrode columns are arranged on the seating body 211 side by side. A lead wire is arranged on one end of the electrode column to be connected to the conductive connection element of the heating body 322, and the other end of the electrode column is connected to the power supply device.

A second embodiment of the atomizer of the present disclosure is shown in FIGS. 9-12. The atomizer is provided and includes a base 20, a housing 10 sleeved on the base 20 and having a sealed connection with the base 20 to define a liquid storage cavity 111, an electrode 90 arranged on a bottom of the base 20, a liquid injection member 109 arranged on the base 20 used to inject liquid into the liquid storage cavity 111, an atomizer body arranged on the base 20, a airflow channel through the whole atomizer, and a liquid suction structure 101. The atomizer body includes an atomizing member 30. The airflow channel includes an air inlet channel 131, an atomizing cavity 311, and an air outlet channel 121. The liquid suction structure 101 is disposed in the air outlet channel 121, a plurality of liquid storage grooves 105 are defined on the liquid suction structure 101 along a circumferential direction. The liquid storage grooves 105 may suck out a condensate in the air outlet channel 121 and/or an incompletely atomized e-liquid brought out during a smoking process. In the present embodiment, the liquid suction structure 101 may be made of one or more of PETG, PCTG and PC.

Specifically, the liquid suction structure 101 includes a plurality of fins 104, the fins 104 are arranged at intervals in parallel along the longitudinal direction. A liquid storage groove 105 is defined between each two adjacent fins 104, a width of the liquid storage groove 105 is configured to be sufficiently small so as to generate a capillary force on the condensate. In this way, liquid drops brought out by smoke generated during the suction process may be retained in the liquid storage grooves 105 in response to passing through a structure of the fins 104, and further to form a liquid film in the liquid storage grooves 105 so as to be stored in the liquid storage grooves 105, and a possibility of liquid leakage may be reduced.

The atomizing member 30 includes a cylindrical atomizing core 321, a liquid guiding cotton 323 surrounding the atomizing core 321, and a heating body 322 entangled on the atomizing core 321. A conductive connection element of the heating body 322 penetrates into the base 20 and is connected to an electrode 90. In some embodiments, the heating body 322 may be a heating wire. During the atomizer being used, the atomizing core 321 absorbs the e-liquid in the liquid storage cavity 111, and the heating body 322 is energized to generate heat, such that the e-liquid in the atomizing core 321 is atomized In response to the user inhales through a suction port of a top cover of the atomizer, the air enters the atomizing core 321 from an air inlet channel 131 under a suction force, mixed with an atomized e-liquid in the atomizing core 321, and discharged from the suction port of the top cover of the atomizer after passing through the air outlet channel 121.

In the present embodiment, the liquid suction structure 101 includes a plurality of fins 104, the fins 104 are arranged at intervals along the longitudinal direction in parallel or non-parallel. A liquid storage groove 105 is defined between each two adjacent fins 104, a width of the liquid storage groove 105 is sufficiently small such that a capillary force on the condensate may be generated. In this way, liquid drops brought out by smoke generated during the suction process may be retained in the liquid storage grooves 105 in response to passing through a structure of the fins 104, and further to form a liquid film in the liquid storage grooves 105 so as to be stored in the liquid storage grooves 105, and a possibility of liquid leakage may be reduced. Both a thickness of the fin 104 and a width of the liquid storage groove 105 are 0.1-0.5 mm, and 0.15-0.3 mm is preferred.

In order to reduce the possibility that the e-liquid is brought out as the suction process in response to excessive e-liquid accumulated in the liquid storage groove 105, in the present embodiment, the liquid suction structure 101 includes at least one liquid returning groove 106 extending along the longitudinal direction. At least part of the liquid storage grooves 105 are slit by the at least one liquid returning groove 106. The e-liquid may return to the atomizing core 321 to be atomized again along the liquid returning groove 106, in response to excessive e-liquid accumulated in the liquid storage groove 105. Specifically, two liquid returning grooves 106 at the same diameter are defined on an inner wall of the liquid suction structure 101. The fins 104 are slit by the liquid returning grooves 106 from a next fin 104 of a top fin 104 of the liquid suction structure 101 to a bottom fin 104. The top fin 104 of the liquid suction structure 101 is used to block a condensate in the liquid returning groove 106 to flow to the air outlet channel 121.

Figure 12:
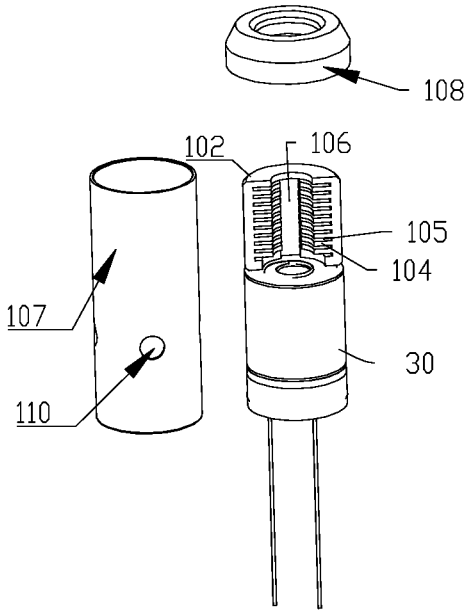
FIG. 12 is a structural schematic diagram of an atomizing member, a sleeve, a suction structure, and a seal element of the present disclosure.

Further, in FIG. 12, in order to make a returning e-liquid better absorbed and re-atomized by the atomizing core 321, a length of the bottom fin 104 of the liquid suction structure 101 extending to a central axis of the liquid suction structure 101 is less than a length of an adjacent fin 104 of the bottom fin 104 extending to the central axis of the liquid suction structure 101.

In some embodiments, the air outlet channel 121 are arranged adjacently to the atomizing member 30 up and down, the liquid suction structure 101 and the air outlet channel 121 are one integral structure, and the liquid storage grooves 105 are defined on the inner wall surface of the air outlet channel 121. In the present embodiment, in FIG. 12, the liquid suction structure 101 and the air outlet channel 121 are two separate structures, and the liquid suction structure 101 includes a cylindrical body disposed directly above the atomizing member 30. The housing 10 includes a housing body and an air outlet tube 12 longitudinally disposed in an inter cavity of the housing body. A complete airflow channel is defined by the air inlet channel 131, the atomizing cavity 311, and the inner cavity of the liquid suction structure 101, and the air outlet tube 12.

The reason that the liquid suction structure 101 is arranged directly above the atomizing core 321 and adjacent to the atomizing core 321 is: in response to an electronic cigarette being heated, there is an oil film generated due to an atomization process, incompletely atomized e-liquid is easily brought out by bubbles generated during the atomization process, and the liquid suction structure 101 arranged directly above the atomizing core 321 may absorb the liquid drops carried by the smoke and store the liquid drops to the liquid storage grooves 105 in response to the smoke rising, such that a possibility of suction liquid leakage may be greatly reduced.

In FIG. 12, the plurality of fins 104 are arranged on an inner wall surface of the cylindrical body. The cylindrical body includes a first part 102 and a second part (not shown) detachably enclosed with the first part 102. A plurality of first fins are arranged on an inner wall surface of the first part 102, and a plurality of second fins are arranged on an inner wall surface of the second part. Specifically, the liquid suction structure is cylindrical, may be formed by combining two semi-cylindricals, and the fins are fan-shaped.

The atomizing member 30 and the liquid suction structure 101 may also be arranged in the same sleeve 107, the liquid suction structure 101 are arranged adjacently to the atomizing member 30. At least one liquid inlet 110 is defined on where the atomizing member 30 corresponds to the sleeve 107. The at least one liquid inlet 110 is used to make the e-liquid stored in the liquid storage cavity 111 enter into the atomizing core 321.

In addition, in order to fix the atomizing member 30 and the liquid suction structure 101 and have a more convenient installation, an outer side wall of the liquid suction structure 101 is closely contacted the inner side wall of the sleeve 107. In some embodiments, the liquid suction structure 101 and the sleeve 107 may be one integral structure.

In order to seal a connection between the sleeve 107 and the air outlet channel 121, a sealing element 108 hermetically connected with the air outlet channel 121 is arranged on the sleeve 107 corresponding to a top of the liquid suction structure 101, and the seal element may be a silicone sleeve or a rubber sleeve. Understandably, in some other embodiments, it is not limited to be the silicone sleeve or the rubber sleeve.

In a second disclosure as shown in FIG. 9-FIG. 12, an electronic atomizing device is also provided and includes a base 20, a housing 10 sleeved on the base 20 and having a sealed connection with the base 20 to define a liquid storage cavity 111, an electrode 90 arranged on a bottom of the base 20, a liquid injection member 109 arranged on the base 20 used to inject liquid into the liquid storage cavity 111, an atomizer body arranged on the base 20, a airflow channel through the whole atomizer, and a liquid suction structure 101. The atomizer body includes an atomizing member 30. The airflow channel includes an air inlet channel 131, an atomizing cavity 311, and an air outlet channel 121. The liquid suction structure 101 is disposed in the air outlet channel 121, a plurality of liquid storage grooves 105 are defined on the liquid suction structure 101 along a circumferential direction. The liquid storage grooves 105 may suck out a condensate in the air outlet channel 121 and/or an incompletely atomized e-liquid brought out during a smoking process. In the present embodiments, the liquid suction structure 101 may be made of one or more of PETG, PCTG and PC. The electronic atomizing device may be a disposable atomizing device with the base, the housing and the atomizer body in an integrated structure, and may also be an atomizing device with the base, the housing and the atomizer body in separate structures.

Specifically, the liquid suction structure 101 includes a plurality of fins 104, the fins 104 are arranged at intervals in parallel along the longitudinal direction. A liquid storage groove 105 is defined between each two adjacent fins 104, a width of the liquid storage groove 105 is sufficiently small such that a capillary force on the condensate may be generated. In this way, liquid drops brought out by smoke generated during the suction process may be retained in the liquid storage grooves 105 in response to passing through a structure of the fins 104, and further to form a liquid film in the liquid storage grooves 105 so as to be stored in the liquid storage grooves 105, and a possibility of liquid leakage may be reduced.

The atomizing member 30 includes a cylindrical atomizing core 321, a liquid guiding cotton 323 surrounding the atomizing core 321, and a heating body 322 entangled on the atomizing core 321. A conductive connection element of the heating body 322 penetrates into the base 20 and is connected to an electrode 90. In some embodiments, the heating body 322 may be a heating wire. During the atomizer being used, the atomizing core 321 absorbs the e-liquid in the liquid storage cavity 111, and the heating body 322 is energized to generate heat, such that the e-liquid in the atomizing core 321 is atomized In response to the user inhales through a suction port of a top cover of the atomizer, the air enters the atomizing core 321 from an air inlet channel 131 under a suction force, mixed with an atomized e-liquid in the atomizing core 321, and discharged from the suction port of the top cover of the atomizer after passing through the air outlet channel 121.

In the present embodiment, the liquid suction structure 101 includes a plurality of fins 104, the fins 104 are arranged at intervals along the longitudinal direction in parallel or non-parallel. A liquid storage groove 105 is defined between each two adjacent fins 104, a width of the liquid storage groove 105 is sufficiently small such that a capillary force on the condensate may be generated. In this way, liquid drops brought out by smoke generated during the suction process may be retained in the liquid storage grooves 105 in response to passing through a structure of the fins 104, and further to form a liquid film in the liquid storage grooves 105 so as to be stored in the liquid storage grooves 105, and a possibility of liquid leakage may be reduced. Both a thickness of the fin 104 and a width of the liquid storage groove 105 are 0.1-0.5 mm, and 0.15-0.3 mm is preferred.

In order to reduce the possibility that the e-liquid is brought out as the suction process in response to excessive e-liquid accumulated in the liquid storage groove 105, in the present embodiment, the liquid suction structure 101 includes at least one liquid returning groove 106 extending along the longitudinal direction. At least part of the liquid storage grooves 105 are slit by the at least one liquid returning groove 106. The e-liquid may return to the atomizing core 321 to be atomized again along the liquid returning groove 106, in response to excessive e-liquid accumulated in the liquid storage groove 105. Specifically, two liquid returning grooves 106 at the same diameter are defined on an inner wall of the liquid suction structure 101. The fins 104 are slit by the liquid returning grooves 106 from a next fin 104 of a top fin 104 of the liquid suction structure 101 to a bottom fin 104. The top fin 104 of the liquid suction structure 101 is used to block a condensate in the liquid returning groove 106 to flow to the air outlet channel 121.

Further, in FIG. 12, in order to make a returning e-liquid better absorbed and re-atomized by the atomizing core 321, a length of the bottom fin 104 of the liquid suction structure 101 extending to a central axis of the liquid suction structure 101 is less than a length of an adjacent fin 104 of the bottom fin 104 extending to the central axis of the liquid suction structure 101.

In some embodiments, the air outlet channel 121 are arranged adjacently to the atomizing member 30 up and down, the liquid suction structure 101 and the air outlet channel 121 being one integral structure, and the liquid storage groove 105 is defined on the inner wall surface of the air outlet channel 121. In the present embodiment, in FIG. 12, the liquid suction structure 101 and the air outlet channel 121 are two separate structures, and the liquid suction structure 101 includes a cylindrical body disposed directly above the atomizing member 30. The housing 10 includes a housing body and an air outlet tube 12 longitudinally disposed in an inter cavity of the housing body. A complete airflow channel is defined by the air inlet channel 131, the atomizing cavity 311, and the inner cavity of the liquid suction structure 101, and the air outlet tube 12.

The reason that the liquid suction structure 101 is arranged directly above the atomizing core 321 and adjacent to the atomizing core 321 is: in response to an electronic cigarette being heated, there is an oil film generated due to an atomization process, incompletely atomized e-liquid is easily brought out by bubbles generated during the atomization process, and the liquid suction structure 101 arranged directly above the atomizing core 321 may absorb the liquid drops carried by the smoke and store the liquid drops to the liquid storage grooves 105 in response to the smoke rising, such that a possibility of suction liquid leakage may be greatly reduced.

In FIG. 12, the plurality of fins 104 are arranged on an inner wall surface of the cylindrical body. The cylindrical body includes a first part 102 and a second part (not shown) detachably enclosed with the first part 102. A plurality of first fins are arranged on an inner wall surface of the first part 102, and a plurality of second fins are arranged on an inner wall surface of the second part. Specifically, the liquid suction structure is cylindrical, may be formed by combining two semi-cylindricals, and the fins are fan-shaped.

The atomizing member 30 and the liquid suction structure 101 may also be arranged in the same sleeve 107, the liquid suction structure 101 are arranged adjacently to the atomizing member 30. At least one liquid inlet 110 is defined on where the atomizing member 30 corresponds to the sleeve 107. The at least one liquid inlet 110 is used to make the e-liquid stored in the liquid storage cavity 111 enter into the atomizing core 321.

In addition, in order to fix the atomizing member 30 and the liquid suction structure 101 and have a more convenient installation, an outer side wall of the liquid suction structure 101 is closely contacted the inner side wall of the sleeve 107. In some embodiments, the liquid suction structure 101 and the sleeve 107 may be one integral structure.

In order to seal a connection between the sleeve 107 and the air outlet channel 121, a sealing element 108 hermetically connected with the air outlet channel 121 is arranged on the sleeve 107 corresponding to a top of the liquid suction structure 101, and the seal member may be a silicone sleeve or a rubber sleeve. Understandably, in some other embodiments, it is not limited to be the silicone sleeve or the rubber sleeve.

By implementing the second embodiment, the following beneficial effects can be obtained.

In the present disclosure, a liquid suction structure is arranged in the air outlet channel, a plurality of liquid storage grooves are defined on the liquid suction structure along a circumferential direction. The liquid storage grooves absorb a condensate out the air outlet channel by the capillary force, such that the condensate and/or the incompletely atomized e-liquid may be remained in the liquid storage grooves, further form a liquid film, and be stored in the liquid storage grooves. In this way, the occurrence of a liquid leakage during a suction process of the user may be reduced, and the user experience may be improved.

Moreover, the liquid suction structure includes a plurality of fins, the fins are arranged at intervals in parallel along the longitudinal direction, and the liquid storage groove is defined between each two adjacent fins. Liquid drops brought out by smoke generated during the suction process may be retained in the liquid storage grooves in response to passing through a structure of the fins.

In order to reduce the possibility that the e-liquid is brought out as the suction process in response to excessive e-liquid accumulated in the liquid storage groove, the liquid suction structure of the present disclosure includes at least one liquid returning groove extending along the longitudinal direction. At least part of the liquid storage grooves are slit by the at least one liquid returning groove. The e-liquid may return to the atomizing core to be atomized again along the liquid returning groove, in response to excessive e-liquid accumulated in the liquid storage groove.

In order to make a returning e-liquid better absorbed and re-atomized by the atomizing core, a length of the bottom fin of the liquid suction structure extending to a central axis of the liquid suction structure is less than a length of an adjacent fin of the bottom fin extending to the central axis of the liquid suction structure.

In addition, in response to an electronic cigarette being heated, there is an oil film generated due to an atomization process, incompletely atomized e-liquid is easily brought out by bubbles generated during the atomization process, and the liquid suction structure arranged directly above the atomizing core may absorb the liquid drops carried by the smoke and store the liquid drops to the liquid storage grooves in response to the smoke rising, such that a possibility of suction liquid leakage may be greatly reduced.

Figure 9:
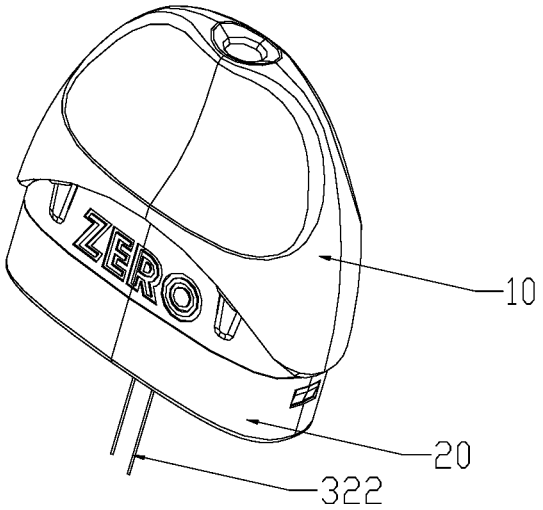
FIG. 9 is a first structural schematic view of an atomizer of the present disclosure.
Figure 10:
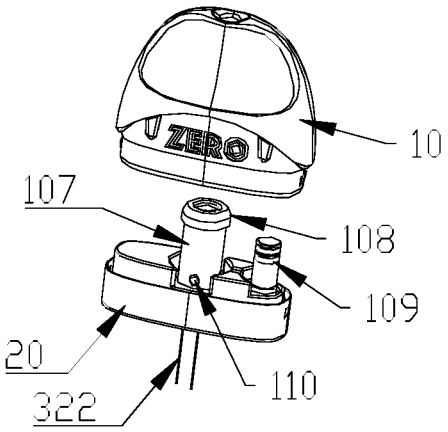
FIG. 10 is a second structural schematic view of the atomizer of the present disclosure.
Figure 11:
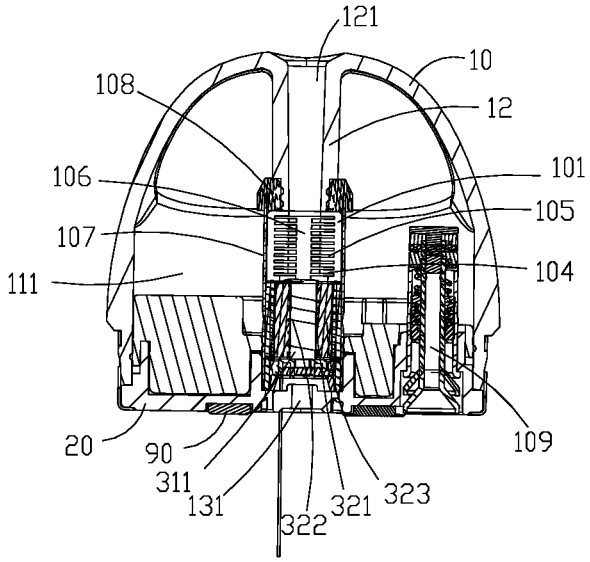
FIG. 11 is a cross-sectional structural schematic view of the atomizer of the present disclosure.

A third embodiment is shown in FIGS. 9, 10, 11, 13-17. In FIGS. 9, 10 and 11, the atomizer is provided and includes a base 20, a housing 10 sleeved on the base 20 and having a sealed connection with the base 20 to define a liquid storage cavity 111, an electrode 90 arranged on a bottom of the base 20, a liquid injection member 109 arranged on the base 20 and used to inject liquid into the liquid storage cavity 111, an atomizer body arranged on the base 20, a airflow channel through the whole atomizer, a first liquid suction structure and a second liquid suction structure. The atomizer body includes an atomizing member 30. The airflow channel includes an air inlet channel 131, an atomizing cavity 311, and an air outlet channel 121. The first liquid suction structure has a fluid connection with the second liquid suction structure on the air outlet channel 121. The first liquid suction structure and the second liquid suction structure absorb a condensate formed on the air outlet channel 121 by the capillary force. The second liquid suction structure is located between the atomizing member 30 and the first liquid suction structure. The capillary force of the second liquid suction structure is greater than the capillary force of the first liquid suction structure. Liquid storage groove 105 that absorb and store the condensate by the capillary force are defined on the second liquid suction structure. The condensate in the first liquid suction structure reaches the second liquid suction structure by the capillary force of the liquid storage groove 105 and is then absorbed and stored.

In the present embodiment, the second liquid suction structure has an inner wall. The inner wall is concaves to form the liquid storage groove 105. The inner wall of the second liquid suction structure encloses a part of the air outlet channel 121. The first liquid suction structure is a liquid suction groove 122 extending along a longitudinal direction of the inner wall of the air outlet channel 121, and one end of the liquid suction groove 122 is butted with the liquid storage groove 105.

In the present embodiment, the air outlet channel 121 includes a first airway wall 1213 and a second airway wall 1214 detachable with the first airway wall 1213. The first liquid suction structure is defined on the first airway wall 1213, and the second airway wall 1214 is an inner wall of the first liquid suction structure. As shown in FIG. 11, the housing 10 includes a housing body and an air outlet tube 12 longitudinally disposed in an internal cavity of the housing body. The second liquid suction structure is disposed below the air outlet tube 12, the first airway wall 1213 is the air outlet tube 12, and the second airway wall 1214 is the inner wall of the first liquid suction structure. A complete air outlet channel 121 is formed with the air outlet tube 12 and an inner cavity of the second liquid suction structure.

In other embodiments, the second liquid suction structure may be defined on an integrally-formed single element, for example, the air outlet tube 12 are arranged adjacently to the atomizing member 30 up and down, the second liquid suction structure and the air outlet tube 12 are one integral structure, and the liquid storage grooves 105 are defined on the inner wall surface of the air outlet tube 12. In the present embodiment, the second liquid suction structure and the air outlet tube 12 are two separate structures, and the second liquid suction structure includes a cylindrical body disposed directly above the atomizing member 30. A complete airflow channel is defined by the air inlet channel 131, the atomizing cavity 311, the inner cavity of the second liquid suction structure, and the air outlet tube 12.

Figure 13:
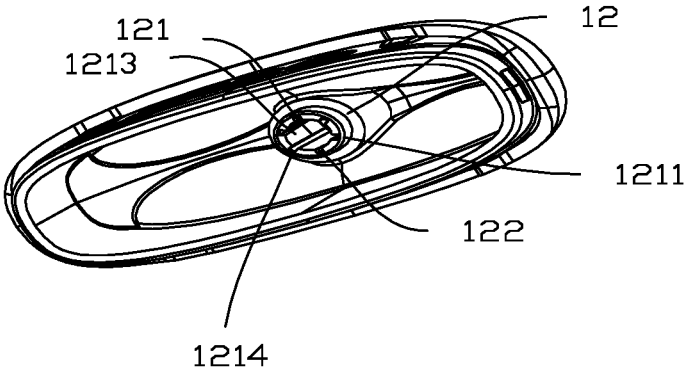
FIG. 13 is a first structural schematic view of an air outlet tube of the present disclosure.
Figure 14:
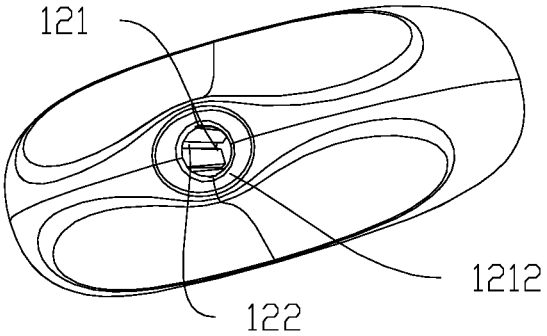
FIG. 14 is a second structural schematic view of the air outlet tube of the present disclosure.

As shown in FIGS. 13 and 14, the air outlet tube 12 includes a first end 1211 close to the atomizing member 30 and a second end 1212 away from the atomizing member 30. The liquid suction groove 122 extends longitudinally from the first end 1211 of the air outlet tube 12 toward the second end 1212 of the air outlet tube 12. The number of the liquid suction groove 122 is several. The liquid suction grooves 122 are evenly distributed along a peripheral wall of the air outlet channel 121 and substantially parallel to a central axis of the air outlet channel 121. The first liquid suction structure may be detachably connected or fixedly connected to an inner side wall of the air outlet tube 12. In the present embodiment, the first liquid suction structure is fixedly connected to the inner side wall of the air outlet tube 12, that is, the first liquid suction structure and the air outlet tube 12 are one integral structure. At least one longitudinally extending liquid suction groove 122 is defined on the inner side wall of the air outlet tube 12. The liquid suction groove 122 is not limited to be disposed in the longitudinal direction, may be disposed spirally, or obliquely, or the inner side wall surface is arranged with a rough surface texture to increase wettability of a surface of the condensate. In other embodiments, a liquid leakage guiding element is fixed on the inner side wall of the air outlet tube 12 in detachably connection manners such as pasting, clamping, and so on.

As shown in FIG. 11, the atomizing member 30 includes a cylindrical atomizing core 321, a liquid guiding cotton 323 surrounding the atomizing core 321, and a heating body 322 entangled on the atomizing core 321. A conductive connection element of the heating body 322 penetrates into the base 20 and is connected to an electrode 90. In some embodiments, the heating body 322 may be a heating wire. During the atomizer being used, the liquid guiding cotton 323 absorbs the e-liquid in the liquid storage cavity 111, and the heating body 322 is energized to generate heat, such that the e-liquid in the atomizing core 321 is atomized In response to the user inhales through a suction port of a top cover of the atomizer, the air enters the atomizing core 321 from an air inlet channel 131 under a suction force, mixed with an atomized e-liquid in the atomizing cavity 311 of the atomizing core 321, and discharged from the suction port of the top cover of the atomizer after passing through the air outlet channel 121.

In response to the atomized gas reaching an air outlet through the air outlet channel 121, a gas flow around the air outlet channel 121 will be condensed to an e-liquid condensate as a result of being contacted with the inner side of the air outlet tube 12, in which case, the condensate will be sucked into the liquid suction groove 122 by a capillary action. Since a capillary force of the liquid storage groove 105 is greater than a capillary force of the liquid suction groove 122, the capillary force of the liquid storage groove 105 may be configured for making the condensate in the liquid suction groove 122 reach the second liquid suction groove under, and further be absorbed and stored.

In order that the condensate absorbed into the liquid suction groove 122 may be better returned back to the second liquid suction structure under the capillary force of the liquid storage groove 105, and further absorbed and stored by the second liquid suction structure, a groove depth of the liquid suction groove 122 is configured to be gradually increased toward the liquid storage groove 105, that is, the groove depth of the liquid suction groove 122 is gradually increased from the second end 1212 to the first end 1211. The groove depth of the liquid suction groove 122 is preferred to be greater than or equal to 0.1 mm.

In some embodiments, a groove width of the liquid suction groove 122 may be configured to be gradually increased toward the liquid storage groove 105, that is, the groove width of the liquid suction groove 122 is gradually increased from the second end 1212 to the first end 1211. And the groove width of the liquid suction groove 122 may be configured to be gradually increased from a bottom of the liquid suction groove 122 to an opening of the liquid suction groove 122. Preferably, the groove width of the liquid suction groove 122 is 0.05-1 mm.

Based on the above-mentioned embodiment for the first liquid suction structure, a bottom of the second liquid suction structure abuts the liquid guiding cotton 323 of the atomizing member 30, a liquid returning structure is arranged on the bottom of the second liquid suction structure to make the liquid storage groove 105 be in fluid connection to the liquid guiding cotton 323 for guiding liquid, such that the condensate in the liquid storage groove 105 may be returned into the liquid guiding cotton 323 to be absorbed and reused. The liquid returning structure is a liquid returning groove or a liquid outlet or a stepped structure.

Figure 15:
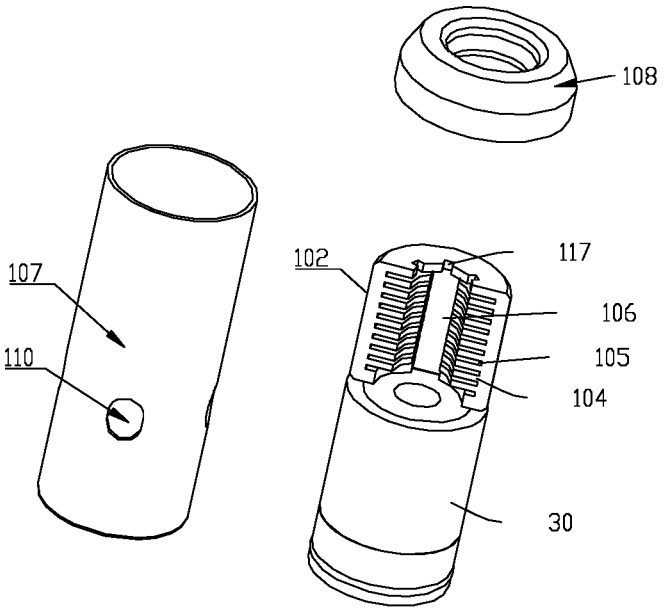
FIG. 15 is a structural schematic diagram of the atomizing member, the sleeve, a horizontal liquid storage groove, and the seal element of the present disclosure.

As shown in FIG. 15, in some embodiments, the liquid storage groove 105 is a substantially horizontal liquid storage groove. Specifically, a plurality of first fins 104 are arranged on an inner wall of the second liquid suction structure. The first fins 104 are arranged at intervals in parallel along the longitudinal direction. A substantially horizontal liquid storage groove 105 is defined between each two adjacent fins 104, a width of the liquid storage groove 105 is configured to be sufficiently small so as to generate a capillary force on the condensate. In this way, liquid drops brought out by smoke generated during the suction process may be retained in the liquid storage grooves 105 in response to passing through a structure of the first fins 104, and further to form a liquid film in the liquid storage grooves 105 so as to be stored in the liquid storage grooves 105, and a possibility of liquid leakage may be reduced.

In order to reduce the possibility that the e-liquid is brought out as the suction process in response to excessive e-liquid accumulated in the liquid storage groove 105, and for the condensate being reused, in the present embodiment, the second liquid suction structure includes at least one liquid returning groove 106 extending along the longitudinal direction. At least part of the liquid storage grooves 105 are slit by the at least one liquid returning groove 106. The e-liquid may return to the liquid guiding cotton 323 to be atomized again along the liquid returning groove 106, in response to excessive e-liquid accumulated in the liquid storage groove 105. Specifically, two liquid returning grooves 106 at the same diameter are defined on an inner wall of the second liquid suction structure. The first fins 104 are slit by the liquid returning grooves 106 from a next fin 104 of a top first fin 104 of the second liquid suction structure to a bottom first fin 104. The top first fin 104 of the second liquid suction structure is used to block a condensate in the liquid returning groove 106 to flow to the air outlet channel 121.

In order to make a returning e-liquid better absorbed and re-atomized by the liquid guiding cotton 323, a length of the bottom first fin 104 of the second liquid suction structure extending to a central axis of the second liquid suction structure is less than a length of an adjacent first fin 104 of the bottom first fin 104 extending to the central axis of the second liquid suction structure.

Since the capillary force of the liquid storage groove 105 may be configured for making the condensate in the liquid suction groove 122 reach the second liquid suction groove and further be absorbed and stored, a first liquid guiding port 117 is defined on the top first fin 104 of the second liquid suction structure, corresponding to the liquid suction groove 122, and used to guide the condensate in the liquid suction groove 122 into the liquid storage groove 105 to be better absorbed and stored by the second liquid suction structure. Specifically, in the present embodiment, the second liquid suction structure is cylindrical, the top first fin 104 is circular, and the other fins are fan-shaped, and the first liquid guiding port 117 is a notch opened on an edge of an inner circular.

As shown in FIG. 15, the plurality of the first fins 104 are arranged on an inner wall surface of the cylindrical body. The cylindrical body includes a first part 102 and a second part (not shown) detachably enclosed with the first part 102. A plurality of the first fins 104 are arranged on an inner wall surface of the first part 102, and a plurality of the first fins 104 are arranged on the inner wall surface of the second part. Specifically, the second liquid suction structure is cylindrical, may be formed by combining two semi-cylindricals. The top first fin 104 is circular, and the other fins are fan-shaped.

Figure 16:
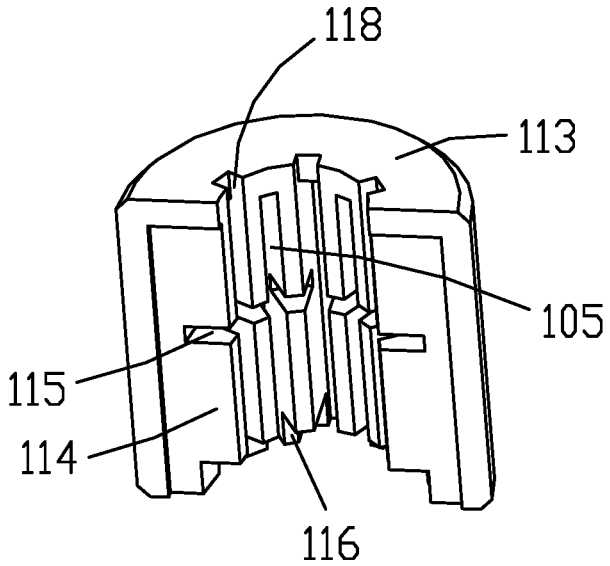
FIG. 16 is a first structural schematic diagram of a longitudinal liquid storage groove of the present disclosure.
Figure 17:
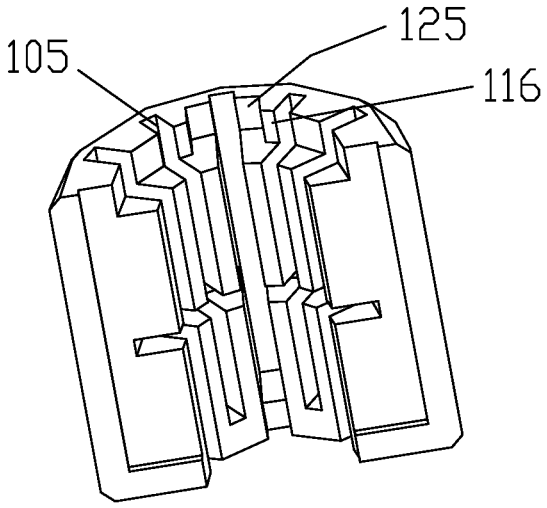
FIG. 17 is a second structural schematic diagram of the longitudinal liquid storage groove of the present disclosure.

As shown in FIGS. 16 and 17, in some embodiments, the liquid storage groove 105 is a longitudinal liquid storage groove. Specifically, the second liquid suction structure is a hollow structure, a top wall 113 is arranged on a top of the second liquid suction structure, and a plurality of liquid storage plates 114 are arranged from the top wall 113 longitudinally extending to a bottom of the second liquid suction structure. The liquid storage plates 114 are arranged at intervals, and the liquid storage groove 105 is defined between each two adjacent liquid storage plates 114.

In order to achieve a better liquid dispense and a better liquid suction, in the present embodiment, the second liquid suction structure further includes at least one liquid guiding groove 115 fluidly coupled to a part of the liquid storage groove 105 and used for dispensing the condensate. Middles of at least part of the liquid storage plates 114 are cross-cut by the liquid guiding groove 115. In some embodiments, the liquid guiding groove 115 and the liquid storage grooves 114 are not limited to be substantially parallel or perpendicular to each other, as long as a cross liquid dispensing may be achieved.

In order to achieve a liquid dispensing at the bottom of the second liquid suction structure, the second liquid suction structure further includes at least one first stepped platform 116 cross-cutting the bottoms of at least part of the liquid storage plates 114 and used for dispensing the condensate. In the present embodiment, the bottoms of all the liquid storage plates 114 are cross-cut by the first stepped platform 116.

In order to make the dispensed condensate be better returned into the atomizing core and be re-atomized, a second stepped platform 125 is arranged on the at least one the first step platform 116. In the present embodiment, the second stepped platforms 125 are arranged on two of the first stepped platforms 116. A step structure is formed by the first stepped platform 116, the second stepped platform 125 and the liquid storage groove 105.

Similarly, Since the capillary force of the liquid storage groove 105 may be configured for making the condensate in the liquid suction groove 122 reach the second liquid suction structure and further be absorbed and stored, a second liquid guiding port 118 is defined on the top wall 113 of the second liquid suction structure and corresponds to the liquid suction groove 122. Specifically, in the present embodiment, the second liquid suction structure is cylindrical, the top wall 113 is circular, and the second liquid guiding port 118 is a notch defined on the edge of the inner circular.

A plurality of the liquid storage plates 114 are arranged on the inner wall surface of the cylindrical body. The cylindrical body includes the first part 102 and the second part detachably enclosed with the first part 102. A plurality of the liquid storage plates 114 are arranged on an inner wall surface of the first part, and a plurality of the liquid storage plates 114 are arranged on an inner wall surface of the second part. Specifically, the second liquid suction structure is cylindrical and may be formed by combining two semi-cylindricals.

In some embodiments, the liquid storage groove 105 is a threaded liquid storage groove and includes second fins arranged spirally on an inner wall of the liquid storage groove 105 to form the liquid storage groove 105 with a threaded structure.

In order to make the condensate in the liquid storage groove 105 be returned into the atomizing core to be re-atomized, the second liquid suction structure includes at least one liquid outlet silting a part of the second fins in the bottom of the liquid storage groove 105.

A plurality of the second fins are arranged on an inner wall surface of the cylindrical body. The cylindrical body includes the first part 102 and the second part (not shown) may detachably enclosed with the first part 102. A plurality of the second fins are arranged on the inner wall surface of the first part 102, and a plurality of the second fins are arranged on the inner wall surface of the second part. Specifically, the second liquid suction structure is cylindrical, may be formed by combining two semi-cylindricals.

In the above-mentioned embodiment, the reason that the second liquid suction structure is arranged directly above the atomizing core 321 and adjacent to the atomizing core 321 is: in response to an electronic cigarette being heated for an atomization, smoke is easily to form a condensate on the gas channel wall as passing through the air outlet channel The second liquid suction structure arranged directly above the atomizing member may absorb the liquid drops carried by the smoke and store the liquid drops to the liquid storage grooves 105, such that a possibility of suction liquid leakage may be greatly reduced.

In some embodiments, the groove depth of the liquid storage groove 105 is greater than or equal to 0.1 mm, and the groove width of the liquid storage groove 105 is 0.05-1 mm. The second liquid suction structure may also be made of one or more of PETG, PCTG and PC.

Moreover, in the present embodiment, as shown in FIG. 11, The atomizing member 30 and the second liquid suction structure may also be arranged in the same sleeve 107, the second liquid suction structure are arranged adjacently to the atomizing member 30, and at least one liquid inlet 110 is defined on where the atomizing member 30 corresponds to the sleeve 107. The at least one liquid inlet 110 is used to make the e-liquid stored in the liquid storage cavity 111 be absorbed by the liquid guiding cotton 323.

In addition, in order to fix the atomizing member 30 and the second liquid suction structure and have a more convenient installation, an outer side wall of the second liquid suction structure is closely contacted the inner side wall of the sleeve 107. In some embodiments, the second liquid suction structure and the sleeve 107 may be one integral structure.

In order to seal a connection between the sleeve 107 and the air outlet channel 121, a sealing element 108 hermetically connected with the air outlet channel 121 is arranged on the sleeve 107 corresponding to a top of the second liquid suction structure, and the seal element may be a silicone sleeve or a rubber sleeve. Understandably, in some other embodiments, it is not limited to be the silicone sleeve or the rubber sleeve.

In a third present disclosure as shown in FIGS. 9, 10 and 11, another electronic atomizing device is provided and includes a base 20, a housing 10 sleeved on the base 20 and having a sealed connection with the base 20 to define a liquid storage cavity 111, an electrode 90 arranged on a bottom of the base 20, a liquid injection member 109 arranged on the base 20 used to inject liquid into the liquid storage cavity 111, an atomizer body arranged on the base 20, a airflow channel through the whole atomizer, a first liquid suction structure and a second liquid suction structure. The atomizer body includes an atomizing member 30. The airflow channel includes an air inlet channel 131, an atomizing cavity 311, and an air outlet channel 121. The first liquid suction structure has a fluid connection with the second liquid suction structure on the air outlet channel 121. The first liquid suction structure and the second liquid suction structure absorb a condensate formed on the air outlet channel 121 by the capillary force. The second liquid suction structure is located between the atomizing member 30 and the first liquid suction structure. The capillary force of the second liquid suction structure is greater than the capillary force of the first liquid suction structure. Liquid storage groove 105 that absorb and store the condensate by the capillary force are defined on the second liquid suction structure. The condensate in the first liquid suction structure reaches the second liquid suction structure by the capillary force of the liquid storage groove 105 and is then absorbed and stored. In the present embodiment, the electronic atomizing device may be a disposable atomizing device with the base, the housing and the atomizer body in an integrated structure, and may also be an atomizing device with the base, the housing and the atomizer body in separate structures.

In the present embodiment, the second liquid suction structure has an inner wall. The inner wall is concaves to form the liquid storage groove 105. The inner wall of the second liquid suction structure encloses a part of the air outlet channel 121. The first liquid suction structure is a liquid suction groove 122 extending along a longitudinal direction of the inner wall of the air outlet channel 121, and one end of the liquid suction groove 122 is butted with the liquid storage groove 105.

In the present embodiment, the air outlet channel 121 includes a first airway wall 1213 and a second airway wall 1214 detachable with the first airway wall 1213. The first liquid suction structure is defined on the first airway wall 1213, and the second airway wall 1214 is an inner wall of the first liquid suction structure. As shown in FIG. 11, the housing 10 includes a housing body and an air outlet tube 12 longitudinally disposed in an internal cavity of the housing body. The second liquid suction structure is disposed below the air outlet tube 12, the first airway wall 1213 is the air outlet tube 12, and the second airway wall 1214 is the inner wall of the first liquid suction structure. A complete air outlet channel 121 is formed with the air outlet tube 12 and an inner cavity of the second liquid suction structure.

In other embodiments, the second liquid suction structure may be defined on an integrally-formed single element, for example, the air outlet tube 12 are arranged adjacently to the atomizing member 30 up and down, the second liquid suction structure and the air outlet tube 12 are one integral structure, and the liquid storage grooves 105 are defined on the inner wall surface of the air outlet tube 12. In the present embodiment, the second liquid suction structure and the air outlet tube 12 are two separate structures, and the second liquid suction structure includes a cylindrical body disposed directly above the atomizing member 30. A complete airflow channel is defined by the air inlet channel 131, the atomizing cavity 311, the inner cavity of the second liquid suction structure, and the air outlet tube 12.

As shown in FIGS. 13 and 14, the air outlet tube 12 includes a first end 1211 close to the atomizing member 30 and a second end 1212 away from the atomizing member 30. The liquid suction groove 122 extends longitudinally from the first end 1211 of the air outlet tube 12 toward the second end 1212 of the air outlet tube 12. The number of the liquid suction groove 122 is several. The liquid suction grooves 122 are evenly distributed along a peripheral wall of the air outlet channel 121 and substantially parallel to a central axis of the air outlet channel 121. The first liquid suction structure may be detachably connected or fixedly connected to an inner side wall of the air outlet tube 12. In the present embodiment, the first liquid suction structure is fixedly connected to the inner side wall of the air outlet tube 12, that is, the first liquid suction structure and the air outlet tube 12 are one integral structure. At least one longitudinally extending liquid suction groove 122 is defined on the inner side wall of the air outlet tube 12. The liquid suction groove 122 is not limited to be disposed in the longitudinal direction, may be disposed spirally, or obliquely, or the inner side wall surface is arranged with a rough surface texture to increase wettability of a surface of the condensate. In other embodiments, a liquid leakage guiding element is fixed on the inner side wall of the air outlet tube 12 in detachably connection manners such as pasting, clamping, and so on.

As shown in FIG. 11, the atomizing member 30 includes a cylindrical atomizing core 321, a liquid guiding cotton 323 surrounding the atomizing core 321, and a heating body 322 entangled on the atomizing core 321. A conductive connection element of the heating body 322 penetrates into the base 20 and is connected to an electrode 90. In some embodiments, the heating body 322 may be a heating wire. During the atomizer being used, the liquid guiding cotton 323 absorbs the e-liquid in the liquid storage cavity 111, and the heating body 322 is energized to generate heat, such that the e-liquid in the atomizing core 321 is atomized In response to the user inhales through a suction port of a top cover of the atomizer, the air enters the atomizing core 321 from an air inlet channel 131 under a suction force, mixed with an atomized e-liquid in the atomizing cavity 311 of the atomizing core 321, and discharged from the suction port of the top cover of the atomizer after passing through the air outlet channel 121.

In response to the atomized gas reaching an air outlet through the air outlet channel 121, a gas flow around the air outlet channel 121 will be condensed to an e-liquid condensate as a result of being contacted with the inner side of the air outlet tube 12, in which case, the condensate will be sucked into the liquid suction groove 122 by a capillary action. Since a capillary force of the liquid storage groove 105 is greater than a capillary force of the liquid suction groove 122, the capillary force of the liquid storage groove 105 may be configured for making the condensate in the liquid suction groove 122 reach the second liquid suction groove under, and further be absorbed and stored.

In order that the condensate absorbed into the liquid suction groove 122 may be better returned back to the second liquid suction structure under the capillary force of the liquid storage groove 105, and further absorbed and stored by the second liquid suction structure, a groove depth of the liquid suction groove 122 is configured to be gradually increased toward the liquid storage groove 105, that is, the groove depth of the liquid suction groove 122 is gradually increased from the second end 1212 to the first end 1211. The groove depth of the liquid suction groove 122 is preferred to be greater than or equal to 0.1 mm.

In some embodiments, a groove width of the liquid suction groove 122 may be configured to be gradually increased toward the liquid storage groove 105, that is, the groove width of the liquid suction groove 122 is gradually increased from the second end 1212 to the first end 1211. And the groove width of the liquid suction groove 122 may be configured to be gradually increased from a bottom of the liquid suction groove 122 to an opening of the liquid suction groove 122. Preferably, the groove width of the liquid suction groove 122 is 0.05-1 mm.

Based on the above-mentioned embodiment for the first liquid suction structure, a bottom of the second liquid suction structure abuts the liquid guiding cotton 323 of the atomizing member 30, a liquid returning structure is arranged on the bottom of the second liquid suction structure to make the liquid storage groove 105 be in fluid connection to the liquid guiding cotton 323 for guiding liquid, such that the condensate in the liquid storage groove 105 may be returned into the liquid guiding cotton 323 to be absorbed and reused. The liquid returning structure is a liquid returning groove or a liquid outlet or a stepped structure.

As shown in FIG. 15, in some embodiments, the liquid storage groove 105 is a substantially horizontal liquid storage groove. Specifically, a plurality of first fins 104 are arranged on an inner wall of the second liquid suction structure. The first fins 104 are arranged at intervals in parallel along the longitudinal direction. A substantially horizontal liquid storage groove 105 is defined between each two adjacent fins 104, a width of the liquid storage groove 105 is configured to be sufficiently small so as to generate a capillary force on the condensate. In this way, liquid drops brought out by smoke generated during the suction process may be retained in the liquid storage grooves 105 in response to passing through a structure of the first fins 104, and further to form a liquid film in the liquid storage grooves 105 so as to be stored in the liquid storage grooves 105, and a possibility of liquid leakage may be reduced.

In order to reduce the possibility that the e-liquid is brought out as the suction process in response to excessive e-liquid accumulated in the liquid storage groove 105, and for the condensate being reused, in the present embodiment, the second liquid suction structure includes at least one liquid returning groove 106 extending along the longitudinal direction. At least part of the liquid storage grooves 105 are slit by the at least one liquid returning groove 106. The e-liquid may return to the liquid guiding cotton 323 to be atomized again along the liquid returning groove 106, in response to excessive e-liquid accumulated in the liquid storage groove 105. Specifically, two liquid returning grooves 106 at the same diameter are defined on an inner wall of the second liquid suction structure. The first fins 104 are slit by the liquid returning grooves 106 from a next fin 104 of a top first fin 104 of the second liquid suction structure to a bottom first fin 104. The top first fin 104 of the second liquid suction structure is used to block a condensate in the liquid returning groove 106 to flow to the air outlet channel 121.

In order to make a returning e-liquid better absorbed and re-atomized by the liquid guiding cotton 323, a length of the bottom first fin 104 of the second liquid suction structure extending to a central axis of the second liquid suction structure is less than a length of an adjacent first fin 104 of the bottom first fin 104 extending to the central axis of the second liquid suction structure.

Since the capillary force of the liquid storage groove 105 may be configured for making the condensate in the liquid suction groove 122 reach the second liquid suction groove and further be absorbed and stored, a first liquid guiding port 117 is defined on the top first fin 104 of the second liquid suction structure, corresponding to the liquid suction groove 122, and used to guide the condensate in the liquid suction groove 122 into the liquid storage groove 105 to be better absorbed and stored by the second liquid suction structure. Specifically, in the present embodiment, the second liquid suction structure is cylindrical, the top first fin 104 is circular, and the other fins are fan-shaped, and the first liquid guiding port 117 is a notch opened on an edge of an inner circular.

As shown in FIG. 15, the plurality of the first fins 104 are arranged on an inner wall surface of the cylindrical body. The cylindrical body includes a first part 102 and a second part (not shown) detachably enclosed with the first part 102. A plurality of the first fins 104 are arranged on an inner wall surface of the first part 102, and a plurality of the first fins 104 are arranged on the inner wall surface of the second part. Specifically, the second liquid suction structure is cylindrical, may be formed by combining two semi-cylindricals. The top first fin 104 is circular, and the other fins are in shapes of fan.

As shown in FIGS. 16 and 17, in some embodiments, the liquid storage groove 105 is a longitudinal liquid storage groove. Specifically, the second liquid suction structure is a hollow structure, a top wall 113 is arranged on a top of the second liquid suction structure, and a plurality of liquid storage plates 114 are arranged from the top wall 113 longitudinally extending to a bottom of the second liquid suction structure. The liquid storage plates 114 are arranged at intervals, and the liquid storage groove 105 is defined between each two adjacent liquid storage plates 114.

In order to achieve a better liquid dispense and a better liquid suction, in the present embodiment, the second liquid suction structure further includes at least one liquid guiding groove 115 fluidly coupled to a part of the liquid storage groove 105 and used for dispensing the condensate. Middles of at least part of the liquid storage plates 114 are cross-cut by the liquid guiding groove 115. In some embodiments, the liquid guiding groove 115 and the liquid storage grooves 114 are not limited to be substantially parallel or perpendicular to each other, as long as a cross liquid dispensing may be achieved.

In order to achieve a liquid dispensing at the bottom of the second liquid suction structure, the second liquid suction structure further includes at least one first stepped platform 116 cross-cutting the bottoms of at least part of the liquid storage plates 114 and used for dispensing the condensate. In the present embodiment, the bottoms of all the liquid storage plates 114 are cross-cut by the first stepped platform 116.

In order to make the dispensed condensate be better returned into the atomizing core and be re-atomized, a second stepped platform 125 is arranged on the at least one the first step platform 116. In the present embodiment, the second stepped platforms 125 are arranged on two of the first stepped platforms 116. A step structure is formed by the first stepped platform 116, the second stepped platform 125 and the liquid storage groove 105.

Similarly, Since the capillary force of the liquid storage groove 105 may be configured for making the condensate in the liquid suction groove 122 reach the second liquid suction structure and further be absorbed and stored, a second liquid guiding port 118 is defined on the top wall 113 of the second liquid suction structure and corresponds to the liquid suction groove 122. Specifically, in the present embodiment, the second liquid suction structure is cylindrical, the top wall 113 is circular, and the second liquid guiding port 118 is a notch defined on the edge of the inner circular.

A plurality of the liquid storage plates 114 are arranged on the inner wall surface of the cylindrical body. The cylindrical body includes the first part 102 and the second part detachably enclosed with the first part 102. A plurality of the liquid storage plates 114 are arranged on an inner wall surface of the first part, and a plurality of the liquid storage plates 114 are arranged on an inner wall surface of the second part. Specifically, the second liquid suction structure is cylindrical and may be formed by combining two semi-cylindricals.

In some embodiments, the liquid storage groove 105 is a threaded liquid storage groove and includes second fins arranged spirally on an inner wall of the liquid storage groove 105 to form the liquid storage groove 105 with a threaded structure.

In order to make the condensate in the liquid storage groove 105 be returned into the atomizing core to be re-atomized, the second liquid suction structure includes at least one liquid outlet silting a part of the second fins in the bottom of the liquid storage groove 105.

A plurality of the second fins are arranged on an inner wall surface of the cylindrical body. The cylindrical body includes the first part 102 and the second part (not shown) may detachably enclosed with the first part 102. A plurality of the second fins are arranged on the inner wall surface of the first part 102, and a plurality of the second fins are arranged on the inner wall surface of the second part. Specifically, the second liquid suction structure is cylindrical, may be formed by combining two semi-cylindricals.

In the above-mentioned embodiment, the reason that the second liquid suction structure is arranged directly above the atomizing core 321 and adjacent to the atomizing core 321 is: in response to an electronic cigarette being heated for an atomization, smoke is easily to form a condensate on the gas channel wall as passing through the air outlet channel The second liquid suction structure arranged directly above the atomizing member may absorb the liquid drops carried by the smoke and store the liquid drops to the liquid storage grooves 105, such that a possibility of suction liquid leakage may be greatly reduced.

In some embodiments, the groove depth of the liquid storage groove 105 is greater than or equal to 0.1 mm, and the groove width of the liquid storage groove 105 is 0.05-1 mm. The second liquid suction structure may also be made of one or more of PETG, PCTG and PC.

Moreover, in the present embodiment, as shown in FIG. 11, The atomizing member 30 and the second liquid suction structure may also be arranged in the same sleeve 107, the second liquid suction structure are arranged adjacently to the atomizing member 30, and at least one liquid inlet 110 is defined on where the atomizing member 30 corresponds to the sleeve 107. The at least one liquid inlet 110 is used to make the e-liquid stored in the liquid storage cavity 111 be absorbed by the liquid guiding cotton 323.

In addition, in order to fix the atomizing member 30 and the second liquid suction structure and have a more convenient installation, an outer side wall of the second liquid suction structure is closely contacted the inner side wall of the sleeve 107. In some embodiments, the second liquid suction structure and the sleeve 107 may be one integral structure.

In order to seal a connection between the sleeve 107 and the air outlet channel 121, a sealing element 108 hermetically connected with the air outlet channel 121 is arranged on the sleeve 107 corresponding to a top of the second liquid suction structure, and the seal element may be a silicone sleeve or a rubber sleeve. Understandably, in some other embodiments, it is not limited to be the silicone sleeve or the rubber sleeve.

By implementing the third embodiment, the following beneficial effects can be obtained.

In the present disclosure, a first liquid suction structure and a second liquid suction structure having a fluid connection with the first liquid suction structure are defined on an air outlet channel. The first liquid suction structure and the second liquid suction structure are configured to absorb a condensate formed on the air outlet channel by capillary forces. The second liquid suction structure is located between the atomizing member and the first liquid suction structure, and the capillary force of the second liquid suction structure is greater than the capillary force of the first liquid suction structure. A liquid storage groove that absorbs and stores the condensate by the capillary force is defined on the second liquid suction structure. The condensate in the first liquid suction structure reaches the second liquid suction structure by the capillary force of the liquid storage groove and is then absorbed and stored, such that incompletely atomized e-liquid during a suction process and the condensate generated on the air outlet channel may be absorbed and stored. In this way, the occurrence of a liquid leakage during a suction process of the user may be reduced, and the user experience may be improved.

In addition, a bottom of the second liquid suction structure abuts the liquid guiding cotton 323, a liquid returning structure is arranged on the bottom of the second liquid suction structure to make the liquid storage groove be in fluid connection to the liquid guiding cotton 323 for guiding liquid, such that the condensate in the liquid storage groove may be returned into the liquid guiding cotton 323 to be re-atomized, and a utilization rate of the e-liquid may be improved.

In response to an electronic cigarette being heated for an atomization, smoke is easily to form a condensate on the gas channel wall as passing through the air outlet channel The second liquid suction structure arranged directly above the atomizing member may absorb the liquid drops carried by the smoke and store the liquid drops to the liquid storage grooves, such that a possibility of suction liquid leakage may be greatly reduced.

It is understandable that the above embodiments simply indicate preferred embodiments of the present disclosure. The specific and detailed description for the embodiments should not be construed as a limitation of the scope of the present disclosure. It should be pointed out that for the ordinary skilled in the art, without departing from the concept of the present disclosure, a free combination for above technical features can be made and several modifications and improvements can also be made, all of which belong to the protection scope of the present disclosure. Therefore, all equivalent transformations and modifications to the scope of claims shall fall within the scope covered by the claims of the present disclosure.

What is claimed is:

1. An atomizer, comprising:

an atomizing member; and an airflow channel, including an air outlet channel;

wherein a first liquid suction structure and a second liquid suction structure having a fluid connection with the first liquid suction structure are defined on the air outlet channel, the first liquid suction structure and the second liquid suction structure are configured to absorb a condensate formed on the air outlet channel by capillary forces; the second liquid suction structure is located between the atomizing member and the first liquid suction structure, and the capillary force of the second liquid suction structure is greater than the capillary force of the first liquid suction structure;

wherein a liquid storage groove that absorbs and stores the condensate by the capillary force is defined on the second liquid suction structure;

wherein the condensate in the first liquid suction structure reaches the second liquid suction structure by the capillary force of the liquid storage groove and is then absorbed and stored;

wherein the atomizing member comprises: a cylindrical atomizing core, and a liquid guiding cotton surrounding the atomizing core; the liquid guiding cotton is in the fluid connection to the liquid storage groove of the second liquid guiding structure for guiding liquid;

wherein a bottom of the second liquid suction structure abuts the liquid guiding cotton, and a liquid returning structure is arranged on the bottom of the second liquid suction structure to make the liquid storage groove be in the fluid connection to the liquid guiding cotton for guiding liquid;

wherein the liquid returning structure is a stepped structure formed by a bottom wall of the second liquid suction structure and a groove wall of the liquid storage groove; a top end of the liquid guiding cotton abuts against the groove wall and a side surface of the liquid guiding cotton abuts against the bottom wall.

2. The atomizer according to claim 1, wherein the second liquid suction structure has an inner wall, the inner wall concaves to form the liquid storage groove, and the inner wall of the second liquid suction structure encloses a part of the air outlet channel.

3. The atomizer according to claim 2, wherein the first liquid suction structure is a liquid suction groove extending along a longitudinal direction of an inner wall of the air outlet channel, and one end of the liquid suction groove is butted with the liquid storage groove;

wherein the liquid suction groove comprises a plurality of liquid suction grooves, and the plurality of liquid suction grooves are evenly distributed along a peripheral wall of the air outlet channel and substantially parallel to a central axis of the air outlet channel.

4. The atomizer according to claim 3, a bottom surface of the liquid suction groove is a slope inclined toward a direction away from the atomizing member.

5. The atomizer according to claim 3, wherein a groove depth of the liquid suction groove is configured to be gradually increased toward the liquid storage groove; and/or a groove width of the liquid suction groove is configured to be gradually increased toward the liquid storage groove; and/or the groove width of the liquid suction groove is configured to be gradually increased from a bottom of the liquid suction groove to an opening of the liquid suction groove.

6. The atomizer according to claim 2, wherein the air outlet channel comprises a first airway wall and a second airway wall detachable with the first airway wall, the first liquid suction structure is defined on the first airway wall, and the second airway wall is an inner wall of the first liquid suction structure.

7. The atomizer according to claim 2, wherein the second liquid suction structure is defined on an integrally-formed single element.

8. The atomizer according to claim 2, wherein the second liquid suction structure comprises at least one liquid guiding groove fluidly coupled to a part of the liquid storage groove and used to dispense a condensate.

9. The atomizer according to claim 1, wherein the atomizer further comprises a liquid storage cavity used for accommodating liquid medium, the second liquid suction structure comprises a liquid returning groove slitting at least part of the liquid storage groove, and the liquid returning groove is configured to make the liquid medium in the liquid storage groove return to the atomizing member to be atomized again along the liquid returning groove in response to excessive liquid medium accumulated in the liquid storage groove.

10. The atomizer according to claim 1, wherein the air outlet channel comprises an inner cavity of the second liquid suction structure and an air outlet tube, the first liquid suction structure is defined on the air outlet tube, and the second liquid suction structure is disposed below the air outlet tube.

11. An electronic atomizing device, comprising:

an atomizing member; and an airflow channel, including an air outlet channel;

wherein a first liquid suction structure and a second liquid suction structure having a fluid connection with the first liquid suction structure are defined on the air outlet channel, the first liquid suction structure and the second liquid suction structure are configured to absorb a condensate formed on the air outlet channel by capillary forces; the second liquid suction structure is located between the atomizing member and the first liquid suction structure, and the capillary force of the second liquid suction structure is greater than the capillary force of the first liquid suction structure;

wherein a liquid storage groove that absorbs and stores the condensate by the capillary force is defined on the second liquid suction structure;

wherein the condensate in the first liquid suction structure reaches the second liquid suction structure by the capillary force of the liquid storage groove and is then absorbed and stored;

wherein the atomizing member comprises: a cylindrical atomizing core, and a liquid guiding cotton surrounding the atomizing core; the liquid guiding cotton is in the fluid connection to the liquid storage groove of the second liquid guiding structure for guiding liquid;

wherein a bottom of the second liquid suction structure abuts the liquid guiding cotton, and a liquid returning structure is arranged on the bottom of the second liquid suction structure to make the liquid storage groove be in the fluid connection to the liquid guiding cotton for guiding liquid;

wherein the liquid returning structure is a stepped structure formed by a bottom wall of the second liquid suction structure and a groove wall of the liquid storage groove; a top end of the liquid guiding cotton abuts against the groove wall and a side surface of the liquid guiding cotton abuts against the bottom wall.

12. The electronic atomizing device according to claim 11, wherein the second liquid suction structure has an inner wall, the inner wall concaves to form the liquid storage groove, and the inner wall of the second liquid suction structure encloses a part of the air outlet channel.

13. The electronic atomizing device according to claim 12, wherein the first liquid suction structure is a liquid suction groove extending along a longitudinal direction of an inner wall of the air outlet channel, and one end of the liquid suction groove is butted with the liquid storage groove.

14. The electronic atomizing device according to claim 12, wherein the air outlet channel comprises a first airway wall and a second airway wall detachable with the first airway wall, the first liquid suction structure is defined on the first airway wall, and the second airway wall is an inner wall of the first liquid suction structure.

15. The electronic atomizing device according to claim 12, wherein the second liquid suction structure comprise at least one liquid guiding groove fluidly coupled to a part of the liquid storage groove and used to dispense a condensate;

the electronic atomizing device further comprises a base;

wherein the at least one liquid guiding groove is defined on a side of the base facing the atomizing member; the base further defines a groove on the side facing the atomizing member; the at least one liquid guiding groove is defined on a side wall of the groove and extends along a longitudinal direction of the base.

16. The electronic atomizing device according to claim 11, wherein the second liquid suction structure is a hollow structure and comprises:

a top wall, arranged on a top of the second liquid suction structure;

liquid storage plates, arranged from the top wall longitudinally extending to a bottom of the second liquid suction structure; and a first stepped platform, cross-cutting the bottoms of at least part of the liquid storage plates, and used for dispensing the condensate;

wherein the liquid storage plates are arranged at intervals, and the liquid storage groove is defined between each two adjacent liquid storage plates.

* * * * *